US007147404B2

(12) United States Patent
Spearing et al.

(10) Patent No.: US 7,147,404 B2
(45) Date of Patent: Dec. 12, 2006

(54) ELONGATE ELEMENT TENSIONING MEMBER

(75) Inventors: Anthony John Spencer Spearing, Aurora, OH (US); Joseph John Jingle, Jr., Medina, OH (US)

(73) Assignee: Atlas Copco MAI GmbH (AT)

( * ) Notice: Subject to any disclaimer, the term of this patent is extended or adjusted under 35 U.S.C. 154(b) by 0 days.

(21) Appl. No.: 11/231,184

(22) Filed: Sep. 20, 2005

(65) Prior Publication Data

US 2006/0072972 A1 Apr. 6, 2006

(30) Foreign Application Priority Data

Sep. 20, 2004 (ZA) ..... 04/7521
Mar. 29, 2005 (ZA) ..... 05/2542

(51) Int. Cl.
*E21D 20/00* (2006.01)

(52) U.S. Cl. ..... 405/259.5; 405/259.4; 405/259.1; 405/302.1

(58) Field of Classification Search .. 405/259.1–259.6, 405/302.1, 302.2, 288
See application file for complete search history.

(56) References Cited

U.S. PATENT DOCUMENTS 3,349,662 A 10/1967 Williams
3,967,455 A 7/1976 Conway
4,339,217 A 7/1982 Lacey
4,378,180 A * 3/1983 Scott ..... 405/259.1
4,431,348 A 2/1984 Powondra
4,776,729 A 10/1988 Seegmiller
5,161,916 A * 11/1992 White et al. ..... 405/259.6
5,253,960 A 10/1993 Scott
5,846,041 A 12/1998 Bevan et al.
5,885,031 A * 3/1999 White ..... 405/259.4
6,474,910 B1 * 11/2002 Lay ..... 405/259.4
6,626,610 B1 * 9/2003 Seegmiller ..... 405/259.5
6,742,966 B1 * 6/2004 Cook ..... 405/259.6
2004/0136789 A1 * 7/2004 Fergusson ..... 405/259.5

FOREIGN PATENT DOCUMENTS

GB 651556 4/1951

* cited by examiner

*Primary Examiner*—Frederick L. Lagman
(74) *Attorney, Agent, or Firm*—Schmeiser, Olsen & Watts

(57) ABSTRACT

An adjustable yield rock bolt that comprises an elongated tensile support member that interacts with at least one gouging member and a receiving member capable of receiving the elongated tensile support member and hold the gouging member segment there between, wherein the elongated tensile support member extends beyond the receiving member a length that corresponds to a predetermined amount of yield before ultimate failure. The bolt has adjustability by allowing for controlled yield by gouging of the elongated tensile support member for any length of displacement.

40 Claims, 23 Drawing Sheets

ELONGATE ELEMENT TENSIONING MEMBER

CROSS REFERENCE TO RELATED APPLICATIONS

This application claims benefit to South African patent application no. 2004/7521 filed on Sep. 20, 2004 and South African patent application no. 2005/02542 filed on Mar. 29, 2005, the contents of both are incorporated by reference in their entirety.

FIELD OF THE INVENTION

This invention relates to an elongated element tensioning member and more particularly but not exclusively a tensioning member which is used for rock stabilisation in mining and tunneling operations.

BACKGROUND

The stabilization of rock in mining and tunneling operations has been of importance since the beginning of the mining industry. Unsupported rock and tunnel walls can collapse killing personnel, destroying equipment and delaying removal of the product because tunnels need to be reopened. This is most important in areas with seismic activities or rock shifting due to tunneling. The conventional rock bolt would yield a small amount from plastic deformation and then suddenly fail without warning because it had insufficient properties to absorb a sufficient amount of energy.

SUMMARY OF THE INVENTION

An adjustable yield rock bolt having a controlled displacement by gouging with a gouging element, which in a first embodiment comprises: an elongated tensile support member; at least one gouging member segment; and a receiving member capable of receiving the elongated tensile support member and having at least one retaining indent to position and hold the gouging member segment there between, wherein the elongated tensile support member extends beyond the receiving member a length that corresponds to a predetermined amount of yield before ultimate failure.

An adjustable yield rock anchor bolt in another embodiment comprises: an elongated tensile support member; at least one gouging member segment, wherein the gouging member segment has an interference fit with the elongated tensile support member; an expandable rock anchor shell that is dimension receive the elongated tensile support member and having at least one retaining indent to position and hold the gouging member segment there between, wherein the elongated tensile support member extends beyond the receiving member a length that corresponds to a predetermined amount of yield before ultimate failure.

An adjustable yield rock anchor bolt in another embodiment comprises: an elongated tensile support member; at least one gouging member segment, wherein the gouging member segment has an interference fit with the elongated tensile support member; a body having a opening (bore) that is dimensioned to receive the elongated tensile support member within the opening (bore) and the opening (bore) having at least one retaining indent to position and hold the gouging member segment there between, wherein the elongated tensile support member extends beyond the receiving member a length that corresponds to a predetermined amount of yield before ultimate failure; and an expandable rock anchor shell that surrounds the body.

An adjustable yield rock anchor bolt in an additional embodiment comprises: an elongated tensile support member having a proximate end and a distal end; at least one gouging member segment, wherein the gouging member segment has an interference fit with the elongated tensile support member; a body having a opening (bore) that is dimensioned to receive the elongated tensile support member at the proximate end within the opening (bore), and the opening (bore) having at least one retaining indent to position and hold the gouging member segment there between, wherein the proximate end of elongated tensile support member extends beyond the body a length that corresponds to a predetermined amount of yield before ultimate failure; an expandable rock anchor shell that surrounds the distal end of elongated tensile support member; and a pretensioning member to move the distal end within the expandable rock anchor shell.

An adjustable yield rock anchor bolt in another embodiment comprises: an elongated tensile support member having a proximate end and a distal end; at least one gouging member segment, wherein the gouging member segment has an interference fit with the elongated tensile support member; a body a opening (bore) that is dimensioned to receive the elongated tensile support member at the proximate end within the opening (bore), and the opening (bore) having at least one retaining indent to position and hold the gouging member segment there between, wherein the proximate end of the elongated tensile support member extends beyond the body a length that corresponds to a predetermined amount of yield before ultimate failure; an movement indicator on the proximate end of the elongated tensile support member that extends beyond the cylinder; an expandable rock anchor shell that surrounds the distal end of elongated tensile support member; and a pretensioning member adjacent to the body to move the distal end within the expandable rock anchor shell.

An adjustable yield grouted rock anchor bolt in another embodiment comprises: an elongated tensile support member; at least one gouging member segment, wherein the gouging member segment has an interference fit with the elongated tensile support member; a body having a opening (bore) that is dimensioned to receive the elongated tensile support member within the opening (bore), and the opening (bore) having at least one retaining indent to position and hold the gouging member segment there between, wherein the elongated tensile support member extends beyond the receiving member a length that corresponds to a predetermined amount of yield before ultimate failure; and a debonder placed upon the elongated tensile support member.

An adjustable yield grouted rock anchor bolt in another embodiment comprises: an elongated tensile support member having a proximate end and a distal end; at least one gouging member segment, wherein the gouging member segment has an interference fit with the elongated tensile support member; a body having a opening (bore) that is dimensioned to receive the elongated tensile support member at the proximate end within the opening (bore), and the opening (bore) having at least one retaining indent to position and hold the gouging member segment there between, wherein the proximate end of elongated tensile support member extends beyond the body a length that corresponds to a predetermined amount of yield before ultimate failure; a debonding material on the elongated tensile member.

A grouted adjustable yield rock anchor bolt in another embodiment comprises: an elongated tensile support member having a proximate end and a distal end; at least one gouging member segment, wherein the gouging member segment has an interference fit with the elongated tensile support member; a body with a opening (bore) that is dimensioned to receive the elongated tensile support member at the proximate end within the opening (bore), and the opening (bore) having at least one retaining indent to position and hold the gouging member segment there between, wherein the proximate end of the elongated tensile support member extends beyond the body a length that corresponds to a predetermined amount of yield before ultimate failure; an movement indicator on the proximate end of the elongated tensile support member that extends beyond the body.

A device for setting pretension on a yielding rock anchor in this embodiment comprises: a pretensioner capable of transmitting force to a body that contains an elongated tension member and a gouging member therein at an untensioned position; a device to develop force through the pretensioner to move the elongated tension member, body, and gouging member into a tensioned position defined where the elongated tension member moves with respect to the body and the gouging member, the gouging member causing deformation in the elongated tension member.

The method of adjusting the total yield of a rock anchor comprising the steps of: selecting an elongated tension member having a known plastic yield; selecting at least one gouging member element; selecting the amount of interference between the gouging member element and the elongated tension member; calculating to ensure the force of the yield caused by the amount of interference to be less than the force required to cause the plastic deformation of the elongated tension member; setting a length of the elongated tension member for the interference between the gouging member element and the elongated tension member.

The embodiment includes a method of adjusting the total yield of a grouted rock anchor comprising the steps of: selecting an elongated tension member having a known plastic yield; selecting a grout having a known yield; selecting at least one gouging member element; selecting the amount of interference between the gouging member element and the elongated tension member; calculating to ensure the force of the yield caused by the amount of interference to be less than the force required for the plastic deformation of the elongated tension member or the yield of the grout; setting a length of the elongated tension member for the interference between the gouging member element and the elongated tension member.

An embodiment of the method for installing an adjustable yield mechanical rock anchor comprising: drilling a hole into a rock face; selecting an anchor shell; selecting an elongated tension member having a proximate and distal end; inserting the distal end of the elongated tension member through the anchor shell; passing the distal end a predetermined distance beyond the anchor shell that corresponds to a desired yield; inserting a gouging member element between the elongated tension member and the anchor shell to form the adjustable yield mechanical rock anchor; inserting the distal end of the elongated tension member of the adjustable yield mechanical rock anchor into the whole; expanding the anchor shell; and attaching a plate to the proximate end.

Another embodiment is the method for installing an adjustable yield mechanical rock anchor comprising: drilling a hole into a rock face; selecting an anchor shell; selecting an elongated tension member having a proximate and distal end; inserting the distal end of the elongated tension member through the anchor shell; inserting the distal end of the elongated tension member and the anchor shell into the hole; expanding the anchor shell; selecting a bale having a opening (bore); passing the proximate end a predetermined distance beyond the bale through the opening (bore) that corresponds to a desired yield; inserting a gouging member element into the opening (bore) between the elongated tension member and the bale to form the adjustable yield mechanical rock anchor; and attaching a plate to the proximate end.

Another embodiment is the method for installing a grouted adjustable yield mechanical rock anchor comprising: drilling a hole into a rock face; selecting an appropriate grout for the rock condition; selecting a bale having a opening (bore); selecting an elongated tension member having a proximate and distal end; inserting the distal end of the elongated tension member through the opening (bore) of the bale; passing the distal end a predetermined distance beyond the bale that corresponds to a desired yield; inserting a gouging member element into the opening (bore) between the elongated tension member and the bale to form the adjustable yield mechanical rock anchor; inserting the distal end of the elongated tension member of the adjustable yield mechanical rock anchor into the hole; grouting the hole; and attaching a plate to the proximate end.

Another embodiment is the method for installing an adjustable yield mechanical rock anchor comprising: drilling a hole into a rock face; selecting an appropriate grout for the conditions; selecting an elongated tension member having a proximate and distal end; inserting the distal end of the elongated tension member through the anchor shell; inserting the distal end of the elongated tension member and the anchor shell into the hole; grouting the anchor shell; selecting a bale having a opening (bore); passing the proximate end a predetermined distance beyond the bale through the opening (bore) that corresponds to a desired yield; inserting a gouging member element into the opening (bore) between the elongated tension member and the bale to form the adjustable yield mechanical rock anchor; and attaching a plate to the proximate end.

A tensioning member according one embodiment of the invention comprises a body having a opening (bore) or a hole of the same cross section of the elongated element so that it corresponds to the passage of an elongated element, wherein a potion or portions of the length of the opening (bore) may be outwardly tapered to one end of the body, and at least one discreet gouging member placed in the opening (bore) into one of the tapers. If more than one discreet gouging member is used they can be placed into a tapered portion or portions spaced about the opening (bore) about the elongated element, in use, which, on movement of the elongated element into the body opening (bore), move into the decreasingly tapered portion or portions of the opening (bore) to grip the elongated element under tension in the opening (bore).

In one form of the invention the tensioning member may be a tapered cone nut in a radially expansible rock anchor head and the tapered portion of the opening (bore) a frusta conical cavity in the body about the elongated element in the opening (bore).

The expansible rock anchor head may be of the type which includes a plurality of anchor shells or leaves which surround the cone nut and which are moved by the cone nut radially outwardly from the rock anchor elongated member. In this embodiment of the invention the elongated tensile member may pass through the cone nut cavity and the gouging members are moved by a gouging effect into the decreasing taper of the cavity of the cone nut to lock the tensile member to the cone nut and cause the cone nut to be pulled into the surrounding anchor shells under tension.

In another embodiment of the invention the tensioning member may be a composite radially expansible rock anchor head wherein the expansion shells or leaves together define the tensioning member with each of the leaves including a tapered flute with the flutes together defining the tapered portions of the opening (bore) in which the gouging members are located.

In yet a further embodiment of the invention the tensioning member may be in the form of a cylindrical body with the opening (bore) passing axially through it and the tapered portion or portions of the bar could be either a frusta conical cavity or a series of tapered flutes which surround the opening (bore) and in which the gouging members are located.

This embodiment may find application in the post tensioning of reinforcing cables against an anchor in a opening (bore) of a structural building component or on the outside of a hole in which a rock anchor rod or cable tendon (elongated tension element) is anchored.

Although the gouging members may be of any suitable shape or form they are less expensive and do not require special manufacture when using hardened mass produced bearings in the shape of round metal balls, commonly known as ball bearings.

A tensioning member according to one embodiment of the invention comprises an anchor head having a opening (bore) there through for the passage of an elongated element with a portion or portions of the length of the opening (bore) being outwardly tapered to one end of the body and a plurality of discreet gouging members in the tapered portion or portions of the opening (bore) about the elongated element which, in use, on movement of the elongated element into the body opening (bore) are moved by the elongated element into the dimensionally decreasingly tapered portion or portions of the opening (bore) to grip the elongated element under tension in the opening (bore).

The elongated element may be a metal bar that is circular, oval, square or "I" or "L" shaped in cross section, being either hollow or solid, and is made from a metal typically having a greater ductility than that from which the anchor head is made. The elongated element can be made by machining, forging, casting, extruding or any other types of known metallurgical processes. When the metal bar may be smooth sided to have a more controlled yield under tension, thus reducing spikes from the gouging members encountering sections having different diameters or surface conditions.

Although the tapered portion of the anchor head opening (bore) could be continuously frusto conical, according to this aspect of the invention, it comprises at least one tapered flute and optionally a plurality of tapered flutes which are spaced about the opening (bore) and in each of which a gouging member is located to minimize spiking.

The portions of the slots which are of least cross-sectional area terminate in the opening (bore) short of the second end of the anchor head.

BRIEF DESCRIPTION OF THE DRAWINGS

Embodiments of the invention are now described by way of non-limiting examples only with reference to the drawings in which one possible embodiment is displayed for illustrative purposes.

DETAILED DESCRIPTION OF THE INVENTION

Figure 1:
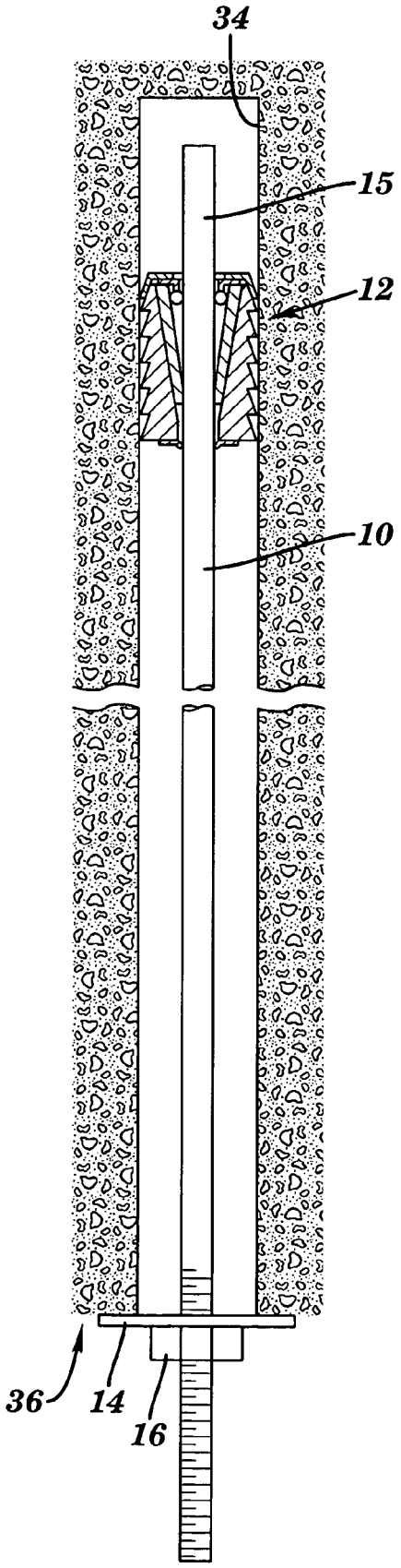
FIG. 1 is a partially sectioned side elevation of one embodiment of the rock anchor of the invention shown located in a predrilled hole.

One embodiment of the rock anchor of the invention is shown in FIG. 1 to include an elongated tensile support member 10, an expansible anchor head 12, a face washer 14 and a tensioning nut 16. The elongated tensile support member 10 may be a steel rod or rebar if machined.

Figure 2:
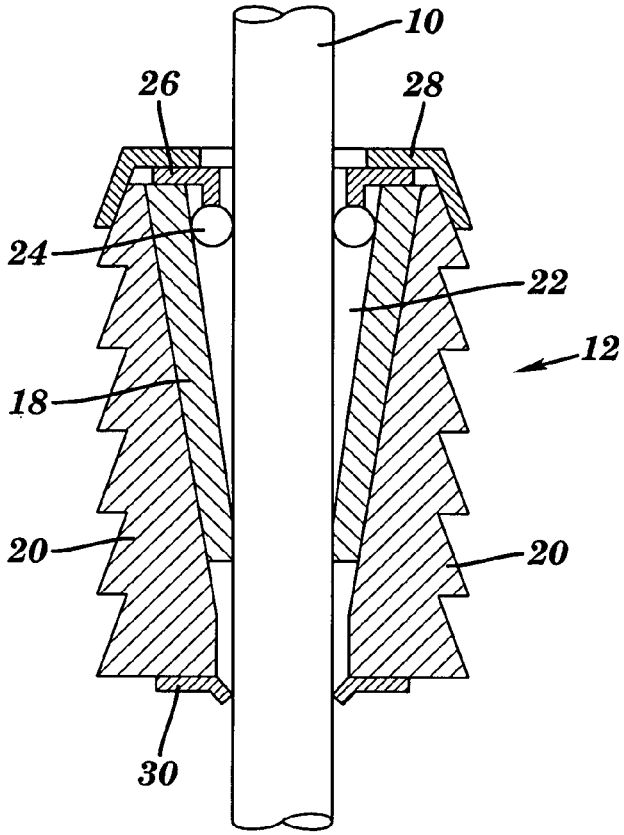
FIG. 2 is an enlarged cross-sectional side elevation of the anchor head of the FIG. 1 rock anchor.
Figure 3:
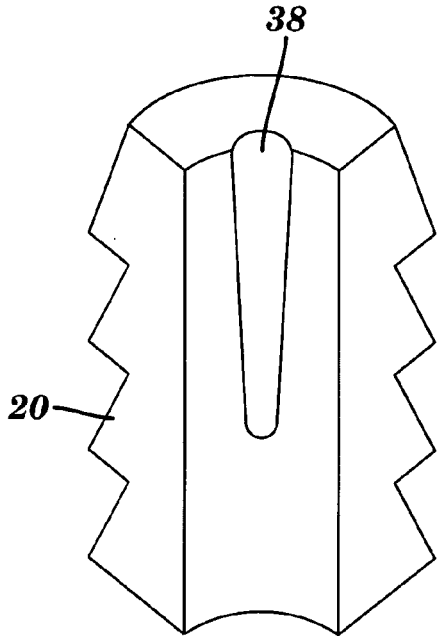
FIG. 3 is an isometric view from above of an anchor shell of a second embodiment of the rock anchor of the invention.

The anchor head 12 is shown in FIG. 2 displays an optional cone nut 18 and, in this embodiment, four anchor leaves or shells 20 which surround the anchor nut 18 and elongated tensile support member 10.

The cone nut 18 of the anchor head 12 includes a frusto conically tapered opening (bore) 22 in which four gouging member segments 24 (hardened ball bearings) are located in an equally spaced relationship about the elongated tensile support member 10, an end cap 26 for retaining the gouging member segments in the tapered opening (bore) 22 of the cone nut, a bale arm disc 28 and a spring washer 30 for holding the anchor head in place on the elongated tensile support member 10. The expansion shells 20 of the anchor head 12 are substantially conventional as is the bale arm disc 28 which is more clearly seen in FIG. 4 to include four bale arms 32 which are spot welded to the upper ends of the four anchor shells 20.

In use the anchor head is located by the spring washer 30 at a desired position at or adjacent the upper end or distal end of the elongated tensile support member 10 and together with the expansion head 12 is fed into a hole 34 which has been predrilled from a rock face 36. The elongated tensile support member 10 is now by hand jerked downwardly to cause the elongated tensile support member 10 to commence moving downwardly through the cone nut 18 and in so doing to engage the gouging segments (balls) 24 to cause them to at least partially rotate downwardly in the frusto conical cavity 22 against the sloping walls of the cavity 20 and the side of the tensile member until the tensile member is lightly locked to the anchor head by radial pressure of the gouging segment (balls) 24 on both the tensile support rod (tendon) 10 and the cone nut 18. The face washer 14 is now located over the free threaded end of the elongated tensile support member 10 and is driven against the rock face 36 by the tensioning nut 16. Continued rotation of the tension nut will now more firmly cause the gouging segment (balls) 24 to be gouging members between the elongated tensile support member 10 and the anchor nut and the elongated tensile support member 10 to be tensioned between the face washer and the anchor head 12, Increasing tension, after setting of the bolt, on the elongated tensile member, perhaps due to rock strata separation, between the anchor head and the face washer 14 will cause the gouging member segment 24 to dig into the cavity 22 side wall and/or the elongated tensile support member which will be gouged by the gouging member segment (balls) to enable the elongated tensile support member 10 to yield while holding the increasing tensile load on it.

The gouging member is any device that has a hardness greater than the elongated tensioning member or the receiving body so that it will deform and displace the surface of the elongated tensioning member. This gouging member can be any shape such as a ball, cylinder, wedge, square, etc that would deform and displace the surface of the elongated member.

Figure 4:
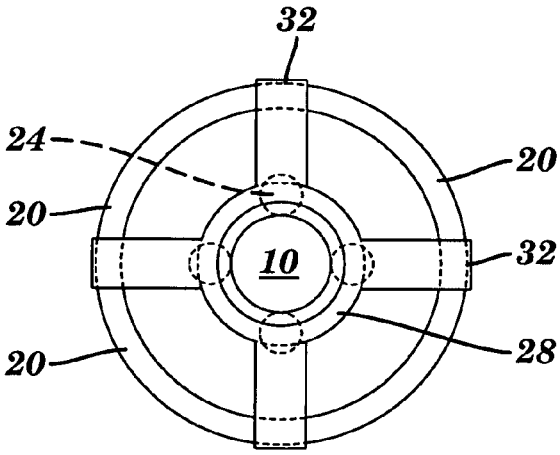
FIG. 4 is a plan view of a rock anchor head including the FIG. 3 anchor shells.

In another embodiment the rock anchor of the invention the cone nut is omitted and the anchor shells 20 include on their inner surfaces, a flute 38 which tapers from the upper ends of the shells to a position in the composite shell opening (bore) in which they shallow out onto the inner surface of the inner arc of the shells 20, as shown in FIG. 4.

An anchor head employing the fluted shells, as shown in FIG. 4, is used in exactly the same manner as the FIG. 1 embodiment in that it includes the end cap 26 and bale disc 28 with the gouging balls being located in the flutes 38 to be in contact with the sloping bases of the flutes and the side of the elongated tensile support member 10.

Figure 5:
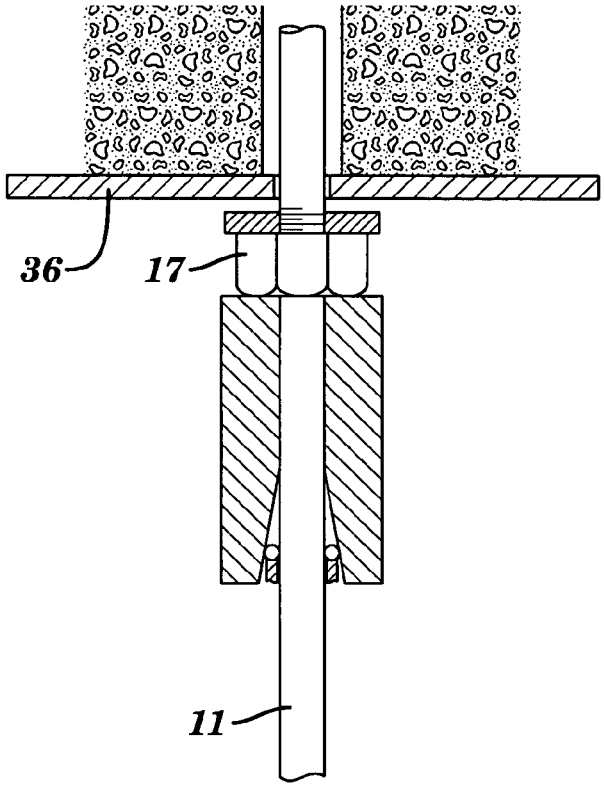
FIG. 5 is a sectioned side elevation of a further embodiment of the tensioning member of the invention externally yielding including a pretensioner installed.
Figure 6:
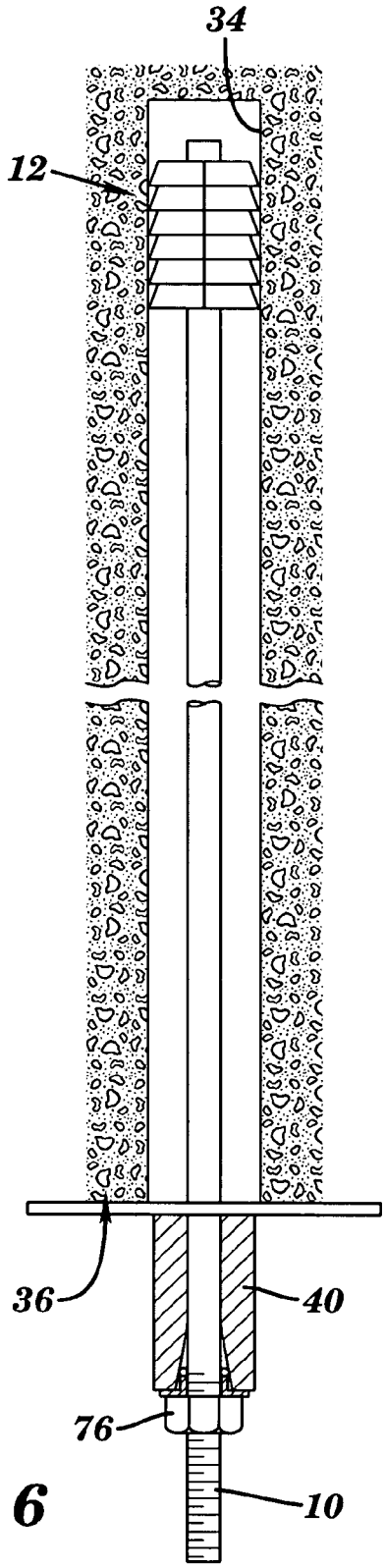
FIG. 6 is a sectioned side elevation of an embodiment of the tensioning member.

In yet a further embodiment the tension member 10 as shown in FIG. 5 is a receiving body 40 with a opening (bore) which can be in a frusto conical shape such as that of the anchor nut 18 of FIGS. 1 and 2, the ball retaining cap 26, the tensioning nut 16 and the gouging member 24. The anchor rod or cable used with this tensioning arrangement could include any form of anchor at its upper or distal end in the predrilled hole 34, as shown in FIG. 6, for anchoring that end of the elongated tensile support member to either the side wall of the hole if the member is to be used with a rock bolt or to a face plate on the opposite end of the hole in the case of a structural concrete element which is to be post tensioned. The elongated tensile support member 10 in this embodiment may be tensioned by means of the nut 16 in the case of a rod, as shown in FIG. 6. If optionally a toe nut is used to tension the rod it is, after use, removed from the threaded end of the rod with the gouging member now being held in the tapered cavity in the opening (bore) of the receiving body 40 by the rod tension. Increased tension on the elongated tensile support member will cause the threaded end to be drawn upwardly through the receiving body 40 while the elongated tensile support member 10 remains load supporting while yielding through the receiving body 40. Alternatively, the elongated tensile support member 10 or a tensioning cable in its place could be tensioned by means of a hydraulic tensioning device.

Figure 8:
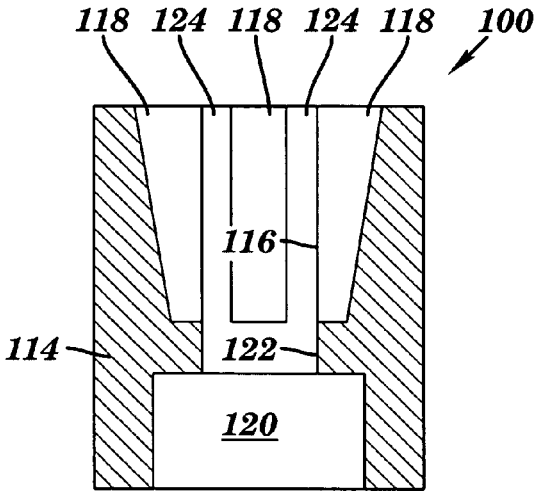
FIG. 8 is a front elevation of the FIG. 7 anchor head shown sectioned on the line 2—2 in FIG. 7.
Figure 9:
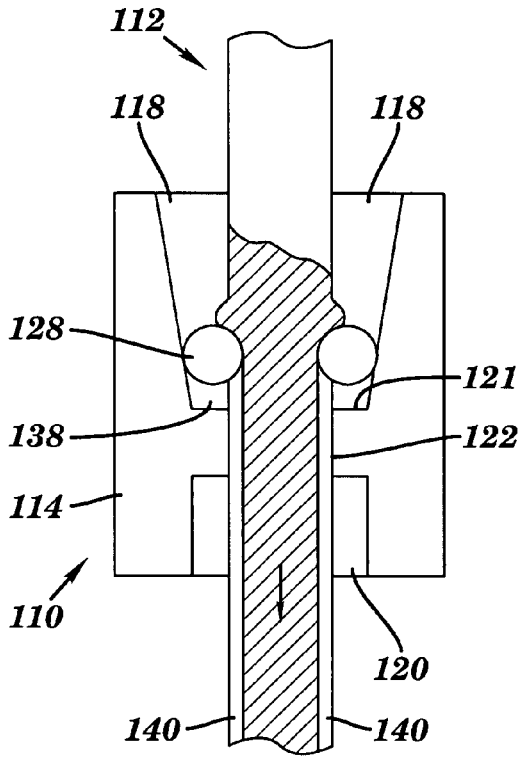
FIG. 9 is a partially diagrammatic sectioned front elevation of the anchor head of FIGS. 7 and 8, in use.
Figure 7:
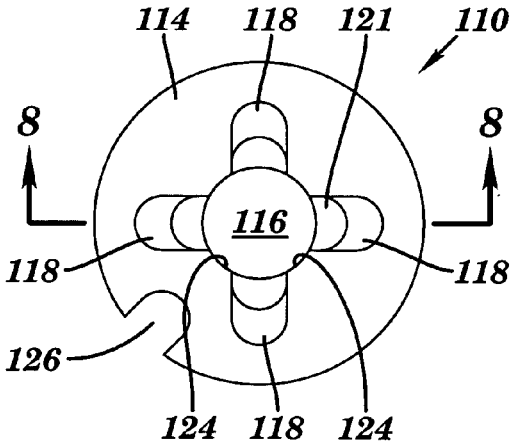
FIG. 7 is a plan view of the anchor head of the rock bolt of the invention.

FIGS. 7 to 9 include a receiving member (anchor head) 100, 110 and an elongated tensile rod 112. The receiving member (anchor head) 100, 110 is shown in these drawings include a receiving body 114 typically a cylindrical hard metal body, which includes a opening (bore) 116 in which the elongated tensile rod 112 is located, in use, at least one retaining indent 118 such as tapered flutes or slots which are uniformly spaced about the opening (bore) 116 and a recess 120 in its underside in which the opening (bore) 116 terminates.

The receiving member (anchor head) 100, 110 with retaining indents 118, taper inwardly from the upper face of the anchor head to a position adjacent the opening (bore) 116 in the head, as shown in FIGS. 8 and 9. The angle of taper of the slots can be from 4–12°, but is typically between 6° and 10° to the axis of the opening (bore) 116. The slots or retaining indent 118 terminate in the opening (bore) 116 at a position above the base of the recess 120 on bases 121 to provide a short circumferentially complete length 122 of the opening (bore) 116 which together with the vertical lands 124 between the sides of the retaining indent 118 provide anti-skewing guidance of the tensile rod 112 through the anchor head opening (bore) 116, in use.

The anchor head or receiving body 100 may include a groove 126 in its outer wall between a pair of slots 118, as shown only in FIG. 7, in which a grouting tube may be located. To cater for the depth of the groove 126 the recess 120 is made to be of a smaller diameter, as shown in FIG. 9, than that of FIG. 8.

The tensile rod 10, 112 is made to a length required in any specific application, it can be any profile or shape, but it is typically circular in cross-section, smooth sided and depending on the embodiment may be threaded over a portion of its length from one end to receive a tensioning nut.

The retaining indents or anchor head slots 118 each carry at least one hardened gouging member element 128, such as a ball bearing which, at the upper end of the slot in which it is located, is smaller in diameter than the distance between the tapered side wall base of the slot and the side of the tensile rod 112 and which lower down in the slot, as shown in FIG. 9, is greater in dimension than the distance between the base of the side wall of the slot and the tensile rod.

Prior to use of the rock anchor, the gouging member inserts 128 are preset into the tensile rod at the required position of the anchor head or receiving body 100 on the tensile rod. The bearings may be preset by locating the anchor head on an anvil over a hole for the tensile rod 10, 112 and then driving the gouging elements (bearings) downwardly under pressure into the indent slots 118 to dig into the sides of the tensile rod. Alternatively the gouging elements (bearings) may be preset by locating the gouging elements (bearings) in the slots 118 of the receiving member 110 with the receiving member (anchor head) above its desired position on the tensile member and then drawing or pulling the tensile rod downwardly through the anvil hole to cause the bearings to gouging member between the tapered side walls of the slots and the sides of the tensile member and then to dig into the softer material of the tensile rod, as shown in FIG. 9 to gouging member lock the anchor head to the tensile rod 116 at its required position on the tensile rod against dislocation from the tensile rod prior to use and during installation of the bolt into a predrilled hole. In FIG. 9 the anchor head is shown with the bearings locked to the tensile rod 112 a little above the semicircular bases 121 of the slots 118. To provide a rock bolt, having a specific tensile rod material ductility, with an almost exact load yield, bearings of a predetermined size are used to provide a predetermined preset penetration into the tensile rod when the bearings are forced onto the slot bases 121 during presetting.

To vary the tensile load at which the tensile rod 10, 112 will yield through the receiving body (anchor head) by ductile deformation of the tensile rod material, in use, the receiving body (anchor head) could include more or less bearing carrying slots 118 than the four shown in the drawings, the gouging member section 128 could be ball bearings, needle bearings, roller bearings, gouging members or any other shape that varied in size and/or by using tensile rods which are made from metal of varying ductility. Additionally, each of the indents or bearing slots 118 could carry a number of suitably dimensioned gouging members 128 which are situated one above another in the slot.

Figure 13:
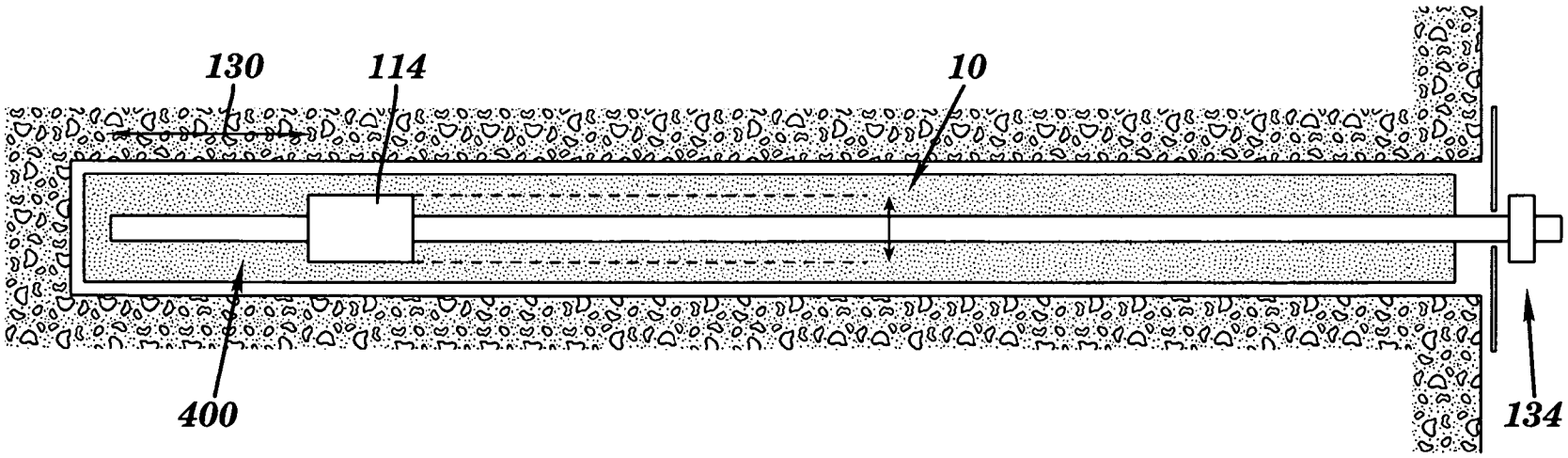
FIG. 13. is an example of a fully grouted rock bolt.

FIG. 13 shows a fully grouted rock bolt with internal yielding. The bolt tensile rod 10 is clad with a de-bonding material which could be a suitable plastics material, wax or by a sleeve of suitable material.

Figure 10:
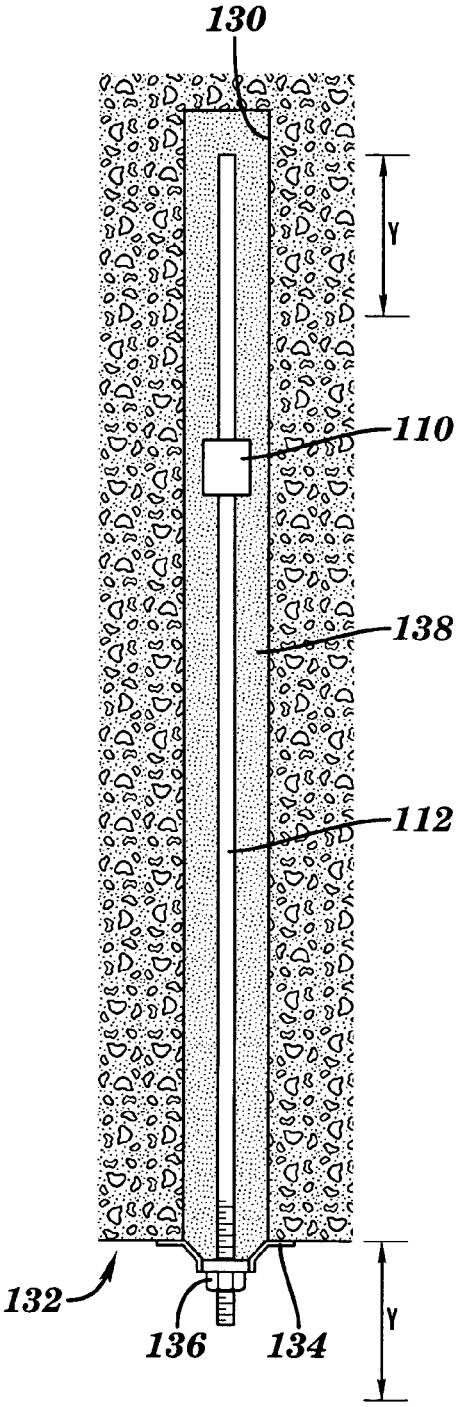
FIG. 10 is a side elevation of the rock bolt of the invention shown located in a predrilled hole in a mine working hanging wall (roof).

In use, as shown in FIG. 10, the rock bolt is placed in a hole 130 which has been predrilled into a rock face 132 with the receiving member (anchor head) 100 located at a predetermined position in the hole.

A face washer 134 and tensioning nut 136 are then located on the optionally threaded end of the tensile rod at the proximate end which projects from the mouth of the hole.

If the tensile rod 112 and receiving member (anchor head) 100 are to be post grouted by a cementitious material in the hole, the rock anchor could include a grouting tube which is located in the anchor head groove 126 to extend between the upper end of the tensile rod 10, 112 in the hole and from a hole in the face washer 134. The grouting tube could be held in position on the anchor head receiver body 100 and tensile rod 10, 112 by suitable plastic ties or the like.

In post grouting the hole 130 a hose from a grout pump is connected to the end of the grout tube on the outside of the hole 130 and the hole is filled with grout 138 to full column grout the roof bolt from the upper end of the hole to the face washer with a hard-setting grout.

To prevent grout from entering the slots or receiving indents 118 as well as the recess 120 in the anchor head as the hole is grout filled, the slots and recess 120 are plugged with a suitable plugging material such as wax, silicone or the like.

Alternatively, the hole may be prefilled with the grout or a suitable resin mix, which could be in conventional capsule form, with the bolt then being driven into the salable material in the hole. With this form of bolt location the upper end of the anchor head could be upwardly tapered to facilitate penetration of an anchor head into the unset grout or resin. In the event that resin is to be used to locate the bolt the bolt will be required to be spun while penetrating and mixing the resin in the usual manner.

In some applications, particularly when using substantially more expensive resins, the hole need only be partially filled from the anchor head to a position below the head at which the yieldability of the rock bolt will not be compromised. In point anchoring a rock bob in this matter it may be necessary to locate a suitable grout plug, which could be made from a resilient material, on the tensile member at a predetermined position spaced from the underside of the anchor head 110 to contain the initially liquid grout in the hole prior to setting.

Figure 11:
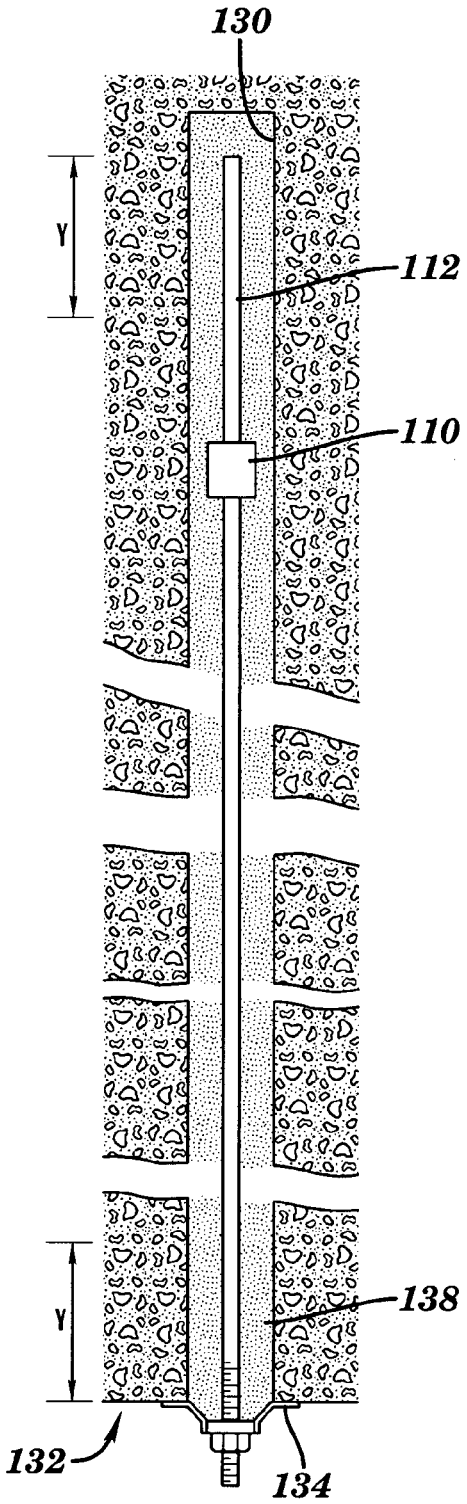
FIG. 11 illustrates the function of the FIG. 10 bolt, in use.

With the rock anchor and those in a pattern around it in a mine working fully set in the holes by the settable material reasonable rock strata separation and dilation, which may be caused by seismic events or the effect of rock over-stressing and hence failure caused by mine working or blasting, will be contained by the yieldability of the rock bolt, as shown in FIG. 11, in which the hanging has closed towards the foot wall and the tensile member has yielded by a dimension Y while remaining load supporting at the design load of the bolt and those surrounding it to safely hold the separated hanging rock against crashing into the mine work area.

The yieldability of the bolt is caused, as shown in FIG. 9, by the increased tension load on the tensile rod 112, in the direction of the arrow in the drawing, causing the gouging member inserts 128, which were previously preset into the tensile rod, to further compress and gouge into and form grooves 140 in the tensile rod, as shown in FIG. 9, below them as the tensile rod is pulled by the descending face washer by the descending rock face against which it bears away from the anchor head, through the relatively stationary anchor head, as shown in FIG. 11 relatively to FIG. 10. The force necessary to cause the bearings to groove the tensile member below them during yield will determine the hanging wall load support capability of the tensile member while yielding. The de-bonding agent with which the tensile rod 112 is clad enables the tensile rod during yielding to move through the settable material, as shown at the upper end of the tensile member in FIG. 11, without interference of the settable material against it so preserving the predictability of yield of the tensile member under a predetermined increasing or increased load. The anchor works in either strong or weak grouts even if the actual strength of the grout is unknown because if the grout is weak the receiving member (bale) will dig into the grout column as opposed to the elongated tension member being gouged if the grout were strong.

Figure 15:
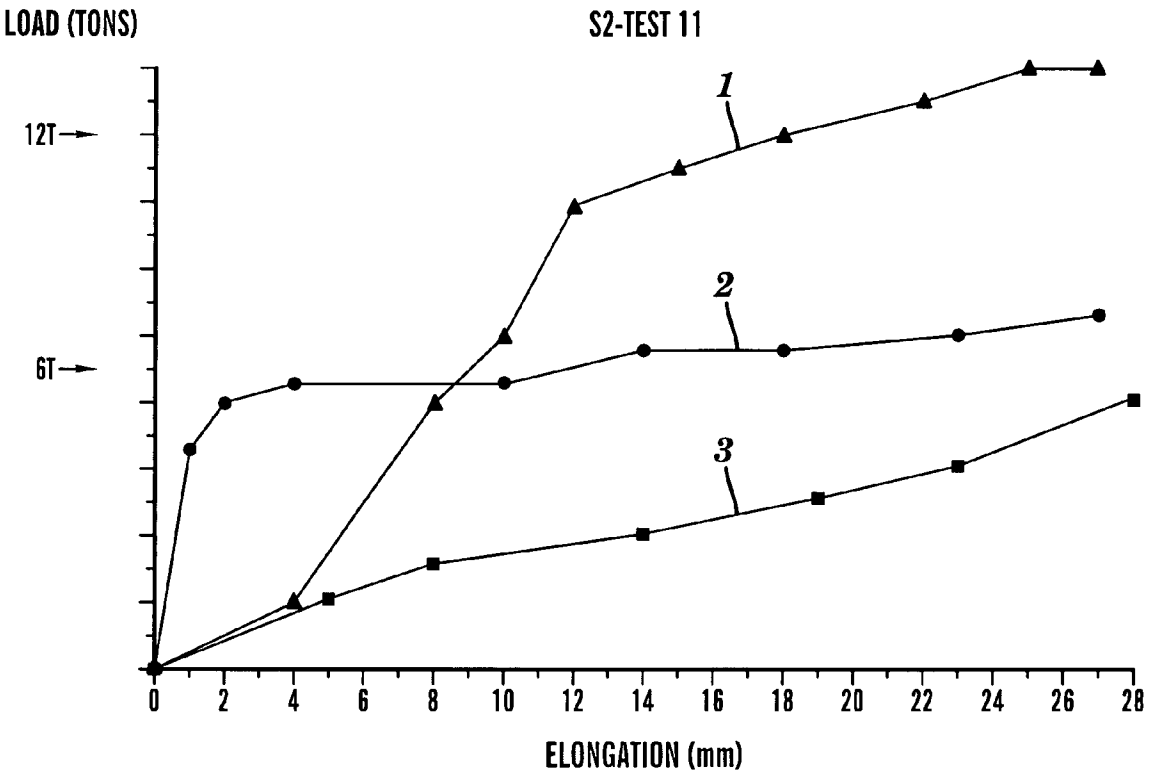
FIG. 15 is a comparison of rock bolt performance.
Figure 16D:
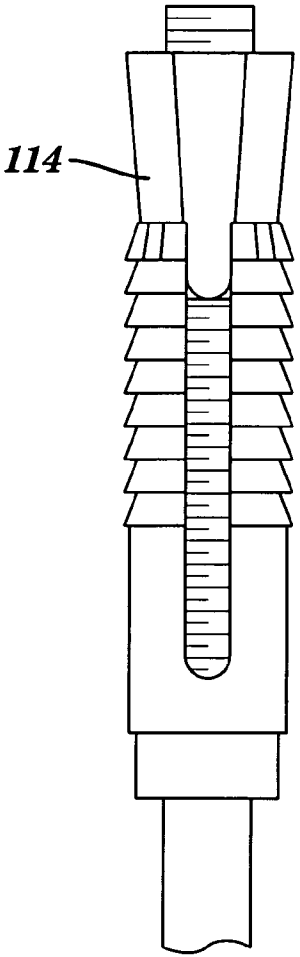
FIG. 16 is an assortment of conventional bales that can be used at the distal end of the elongated member in combination with the invention or the conventional bale can be replaced with a modified bale.
Figure 16C:
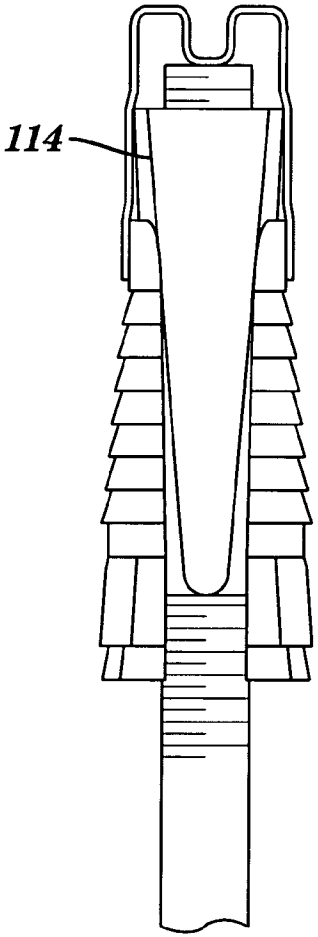
Figure 16B:
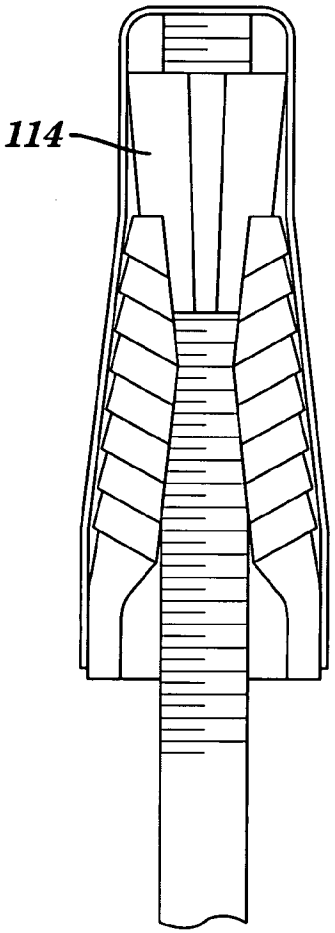
Figure 16A:
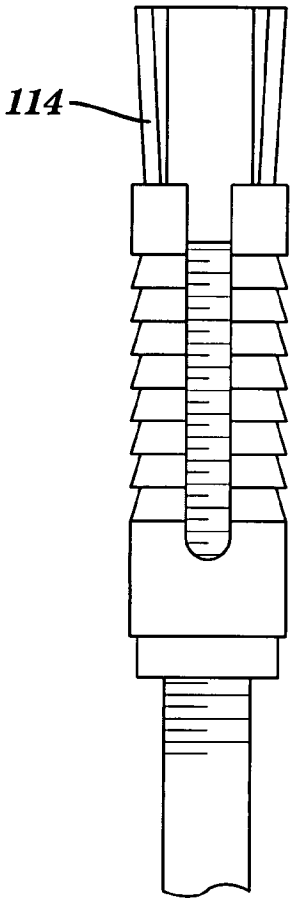

FIG. 15 compares a conventional bolt 1 to a yielding bolt, one preset 2, one not preset 3. The preset yielding bolt 3 was moved or deformed about two inches to preset the bale before load testing, but apart from the presetting both yielding bolts were identical. The yielding bolt can get the same peak values if at the end of the desired yield travel the end is expanded to prevent travel through the receiving body. The degree of design load supporting yieldability that a specific rock anchor of the invention is capable of is determined by the length of the tensile member above the anchor receiving head 100 when set for operation in a hole.

Figure 12:
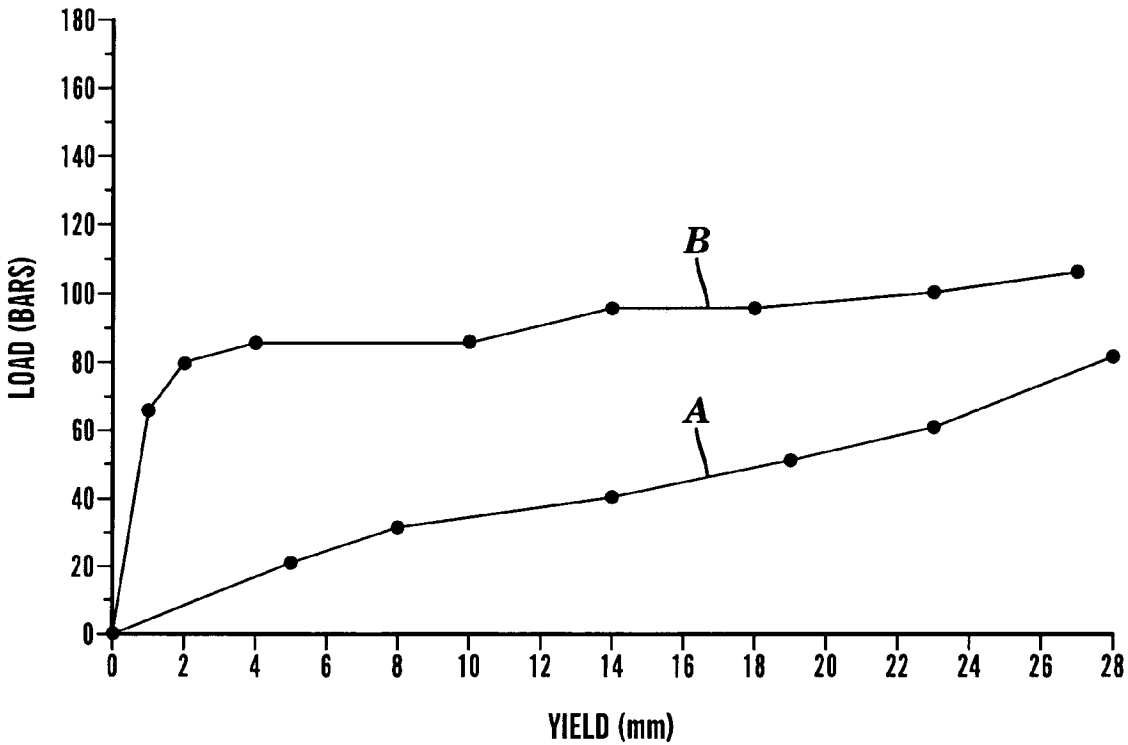
FIG. 12 is a comparative set of graphs illustrating the performance of two rock bolts of the invention.

FIG. 12 illustrates the load supporting capability of two of the anchor bolts of the invention while yielding. The tensile rods 112 of both bolts were smooth sided rods made from C1070 steel which had a diameter of 14 mm, a yield strength of approximately 100,000 psi and an ultimate strength of approximately 140,000 psi. Both anchor receiver heads 100 had a diameter of 42 mm and three indent slots 116 which each housed a single gouging member element ball bearing 128 having a diameter of 0.187 inches. The ball bearings were made of C440 stainless steel.

The bearing gouging member elements 128 of the bolt from which graph A in FIG. 12 was derived during its pull test were not preset into the tensile rod as described and were driven into the tensile rod material only on movement of the tensile member through the anchor receiving head. The bearings of the bolt of graph B on the other hand were preset into the tensile rod material as described above and from the graph it is to be seen that the bolt importantly accepted almost the full tensile load applied to the tensile member during its test with only 2 mm of draw of the tensile member through the anchor head and remained load supporting at between 80 and 110 bars (70 bars=6 tons) while yielding, as shown in the graph.

The invention is not limited to the precise details as herein described. For example, the anchor receiving head of FIG. 8 could terminate at the base of the recess 120 and parallel sided grooves which are narrower and not as deep as the indent slots 118 could extend from the indent slots 118 to the underside of the anchor receiving head to facilitate removal of material on either side of the tensile rod grooves from the anchor head which may otherwise on excessive build-up be periodically extruded from the anchor head across the interface between the tensile rod and the face 122 of the tensile rod opening (bore) to perhaps cause load shedding spikes during yield of the bolt.

An embodiment of the adjustable yield rock bolt is shown throughout FIGS. 1–9 that comprises an elongated tensile support member 10, 112. The tensile member is usually a steel rod such as rebar or other common structural members that are commonly available in the construction industry. All grades and harnesses of steel are considered to be satisfactory. FIG. 2 displays at least one gouging member segment 24, commonly a hardened steel ball bearing that would be used in conjunction with a receiving member 12, 110 as shown in FIGS. 2–9 capable of receiving the elongated tensile support member 10, 112 and having at least one retaining indent 38, 118 to position and hold the gouging member segment 24, 128 there between, wherein the elongated tensile support member 10, 112 extends beyond the receiving member a length Y 130 that corresponds to a predetermined amount of yield before ultimate failure.

Figure 14:
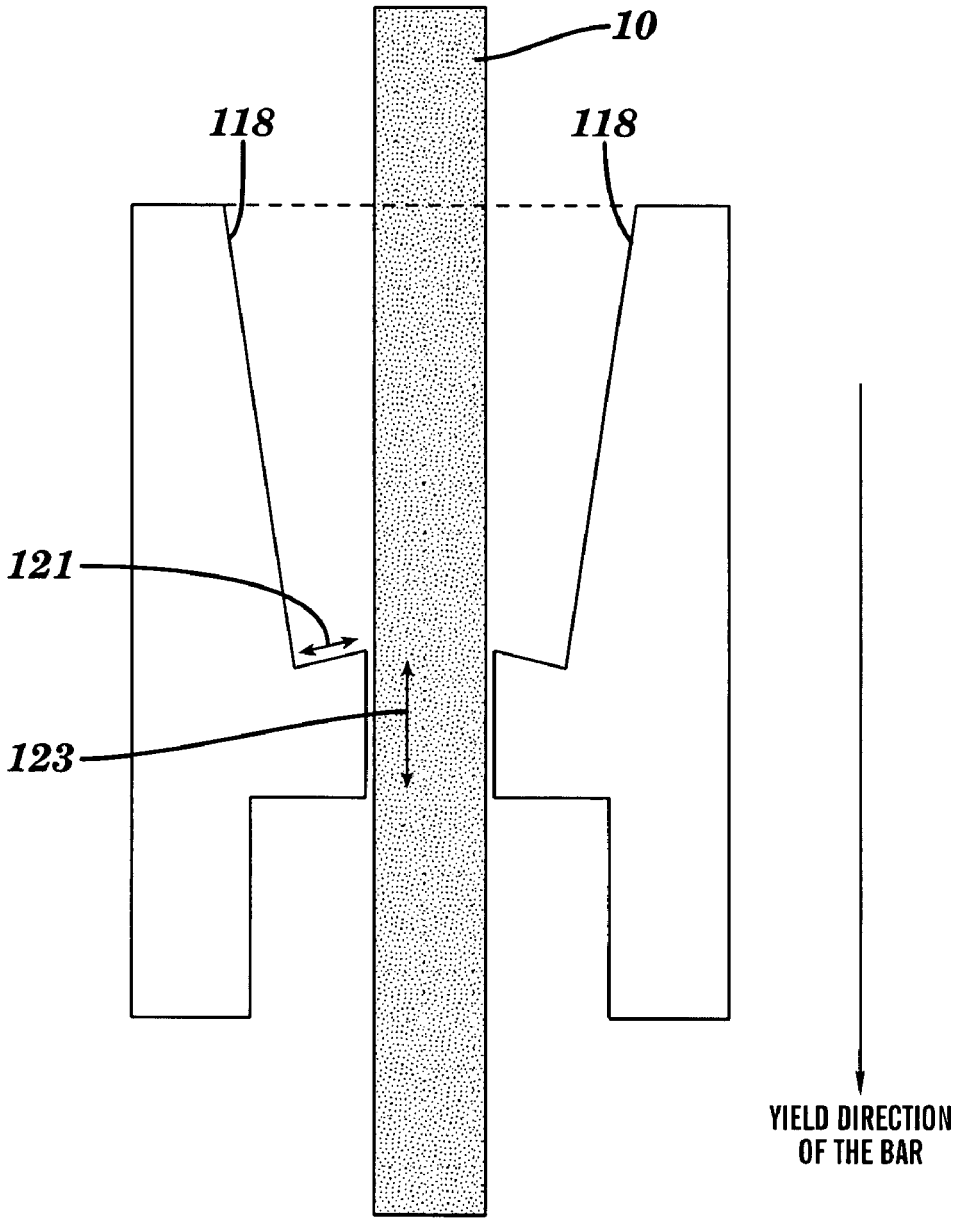
FIG. 14 is a cutaway view of a receiving body (bale).

FIG. 14 displays where the receiving member 100 having a opening (bore) 116 wherein the opening (bore) 116 has at least one entrance diameter 118 and a smaller seat diameter 138 having an angle 150 of 4–12 degrees there between. Additionally FIGS. 9 and 14 display that the opening (bore) has an anti-skewing section 122, wherein the anti-skewing section 122 is defined as having an inner dimension that is not greater than 25% larger than the outer dimension of the elongated tensile support member 10, 112. The step depth 123 and in combination the step width 121 effect the gouging process of the gouging member element that rests on step width 121 after being pre-tensioned. Step width 121 determines the amount of interference between the gouging member element and the elongated tension element. It is important to keep the entire reinforcing member straight and to be fed evenly into the receiving member (bale) to prevent high friction forces and possible bending of the elongated member.

FIG. 1–4 is directed toward an adjustable yield rock anchor bolt comprising an elongated tensile support member 10, that is shown in this example to be rebar that has been machined smooth. The at least one gouging member segment 24 is a hardened steel ball bearing, wherein the gouging member segment 24 has an interference fit with the elongated tensile support member 10. The gouging member segments 24 inserts into the an expandable rock anchor shell 20 that is dimensioned to receive the elongated tensile support member 10 and having at least one retaining indent 38 to position and hold the gouging member segment 24 there between the shell 20 and the tensile support member 10, wherein the elongated tensile support member 10 extends beyond the expandable rock anchor shell 20 a length L 15 that corresponds to a predetermined amount of yield before ultimate failure.

Figure 17A:
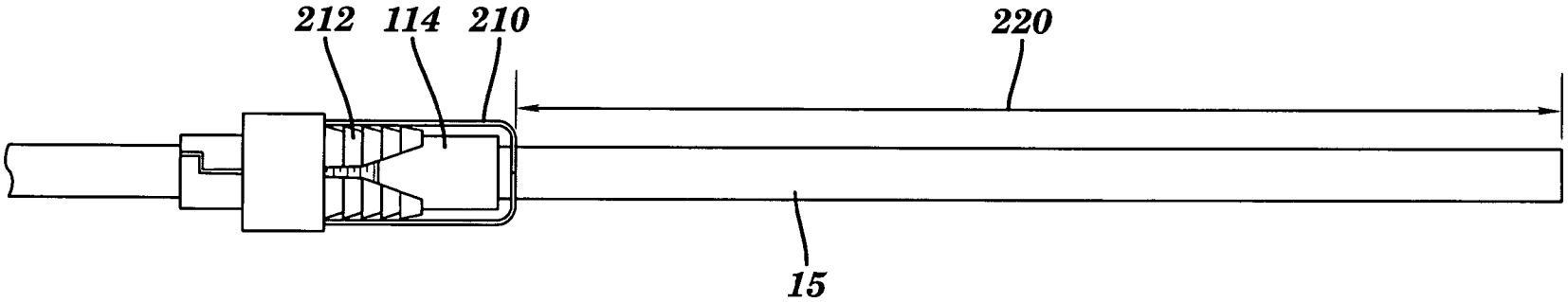
FIG. 17 a comparison of a conventional shell anchor to a modified shell anchor.
Figure 17B:
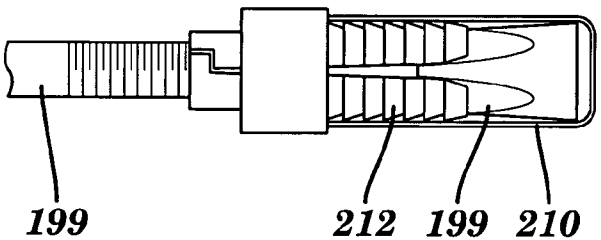
Figure 18:
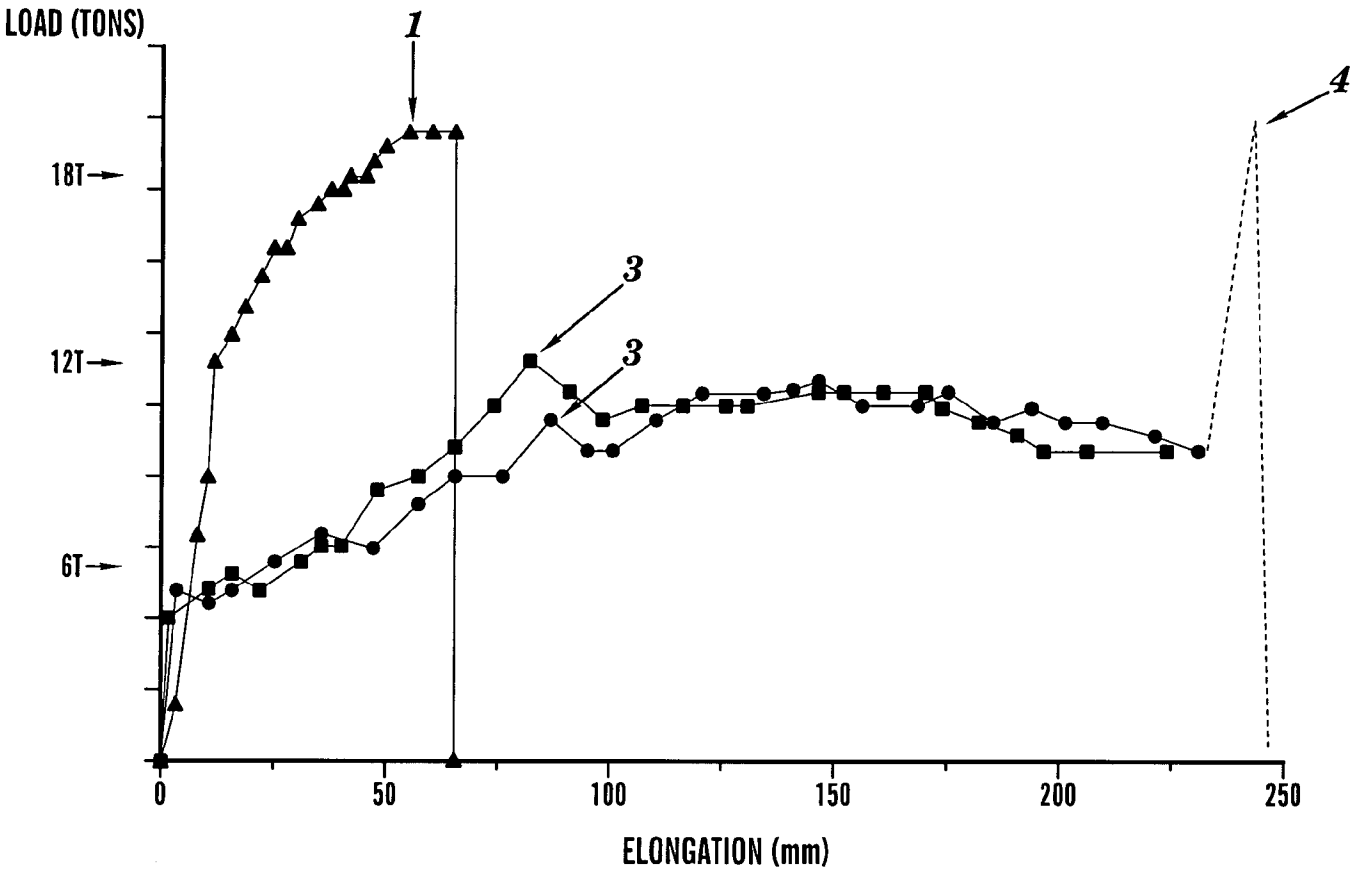
FIG. 18 a comparison of the yield properties of a conventional anchor vs. a yielding mechanical shell anchor, the dotted line represents additional yield possible with the addition of end crimping.

In FIGS. 16–18 a adjustable yield rock anchor bolt embodiment is show comprising an elongated tensile support member 10 with at least one gouging member segment 128 (see FIG. 9), wherein the gouging member segment has an interference fit that results in a groove 140 with the elongated tensile support member displaying a groove 140. FIGS. 7–9 shows a receiving body 114 with a opening (bore) 116 that is dimensioned to receive the elongated tensile support member 112 within the opening (bore) 116 and the opening (bore) 116 having at least one retaining indent 121 to position and hold the gouging member segment 128 there between, wherein the elongated tensile support member (as displayed in FIG. 17) extends beyond the receiving member a length that corresponds to a predetermined amount of yield before ultimate failure. FIG. 16 shows examples of conventional mechanical anchor shells that can be modified by replacing the normal bale with the receiving body 140 as show in FIG. 17 to form expandable rock anchor shell 200 that surrounds the receiving body. The expandable rock shell further comprises a stirrup 210 having a hole 215 to allow the elongated support member 12 to pass through. The yield length 220 that it passes through is the amount of yield and movement that can be adjusted before ultimate failure of the elongated member 10. The yield length is theoretically unlimited with ranges from 2 inches to 200 feet possible, with the only limiting factor being the length of the elongated tensile member 10, the travel distance deemed acceptable before it is considered impractical such as 50% of the height of a tunnel roof from the floor. A typical yield bolt having a yield length ranging from about 5 to 100 inches would be normal range for practical applications, but the range may be increased or decreased depending on the specific application to any theoretical length. FIG. 4 shows where the gouging member segment is a bearing selected from the group consisting of ball bearings, needle bearings, roller bearings, gouging member bearing and a combination thereof (see FIG. 27 for several of many possible examples).

Figure 27C:
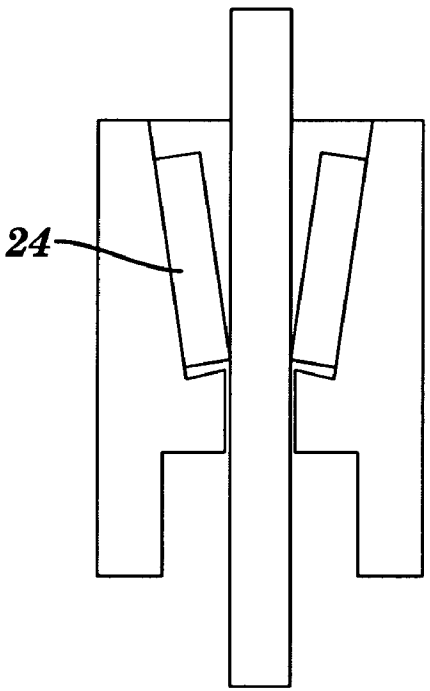
FIG. 27A–E are various embodiments of the gouging member.
Figure 27B:
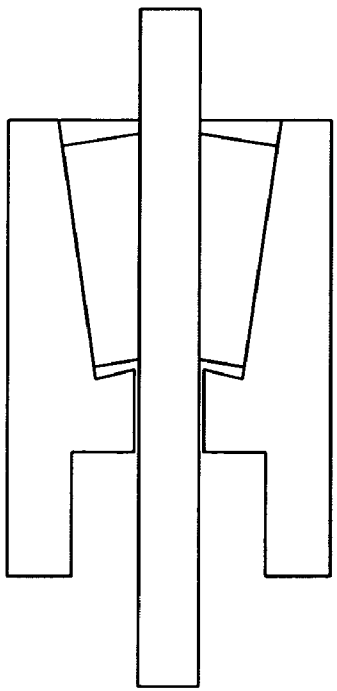
Figure 27A:
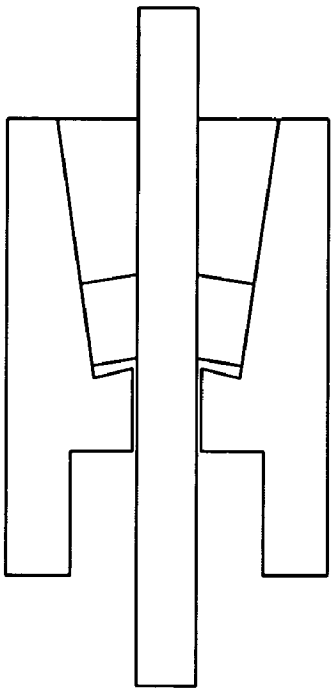
Figure 27E:
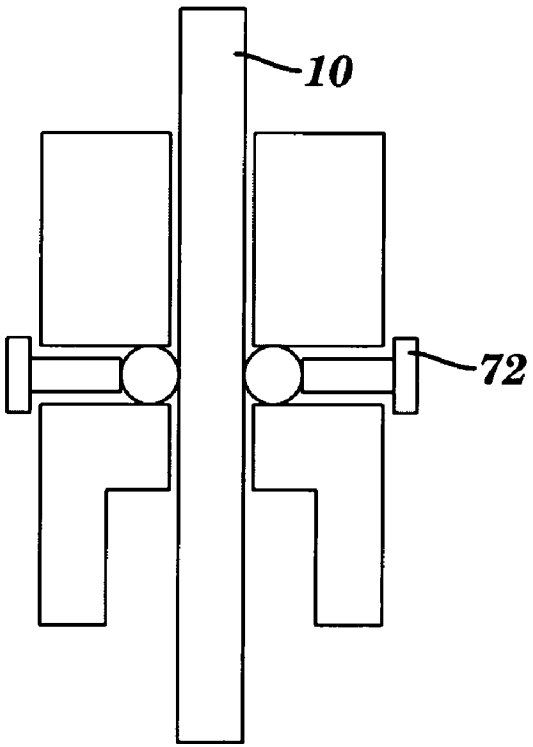
Figure 27D:
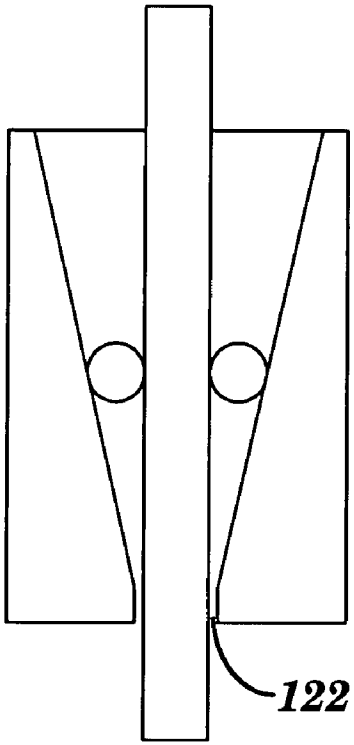

In FIG. 27A the receiving member is shaped to accept gouging members in the form of wedges. The wedge must be made small enough to prevent locking of the elongated member within the receiving member. In FIG. 27B the receiving member is shaped to accept gouging members in the form of conical needle bearings. The conical bearings gouge along their length and when placed in a slot are positioned at an angle of 4–12, but usually 6–8 degrees to the elongated member within the receiving member. FIG. 27C the receiving member is shaped to accept gouging members in the form of needle bearings. In FIG. 27D the receiving member is shaped to accept gouging members in the form of ball bearings, but without having a step. The stepless arrangement prevents locking of the elongated member within the receiving member, but produces less yield then with a step. FIG. 27E is a modified receiving member that uses ball bearings that are positioned by pressure of a threaded screw 72. The assembly could be more easily set at the site for easier adjustability, but the screws may need to be adjusted properly so that the elongated member is properly centered.

FIG. 18 shows a comparison of the conventional mechanical shell anchor 1 and pretensioned yielding mechanical shell anchors 3. The test shows that the yielding anchors 3 to have almost 220 mm of yield before failure instead of just about 60 mm for the conventional anchor 1. The test example was achieved using an embodiment of a receiving member (bale)140 with 4 slots each holding a gouging element 128 that was a 0.156" diameter ball bearing with a step width 121 in the bale of 0.125" for the gouging member elements (bearings) 128 to seat onto The same peak load of over 18 tons in the test that the conventional anchor 1 can be duplicated with a modified yield anchor 4 (shown by dotted path) that prevents the end of the elongated member from passing through the receiving body 140 with reaching ultimate failure, thus reaching the same peak load carrying capacity before failure after a predetermined amount of acceptable yield travel.

The indent to position and hold the gouging member segment can also be a threaded hole that intersects the opening (bore) of the receiving body. Then the gouging member segment is a hardened screw that is set at a predetermined depth to interfere with the elongated tensile support member. In another method the threaded screw could position and hold the gouging member against the elongated member within the receiving body.

FIG. 5 is modified version of FIG. 6 wherein as adjustable yield rock anchor bolt comprising an elongated tensile support member 10 having a proximate end 11 and a distal end 15. The at least one gouging member segment 128, wherein the gouging member segment 128 has an interference fit with the elongated tensile support member 10.

FIGS. 7–9 displays a receiving body 114 with a opening (bore) 116 that is dimensioned to receive the elongated tensile support member 10 at the proximate end 11 within the opening (bore) 116 and the opening (bore) having at least one retaining indent 118 to position and hold the gouging member segment 128 there between, wherein the proximate end 11 (as shown in FIG. 5) of elongated tensile support member extends beyond the receiving body a length that corresponds to a predetermined amount of yield before ultimate failure. As displayed in FIG. 6 a conventional expandable rock anchor shell 12 that surrounds the distal end 15 of elongated tensile support member 10. FIG. 5 shows a pretensioning member 17 adjacent to the receiving body 40, 114 to move the distal end 15 within the expandable rock anchor shell 12 and set the gouging elements. The tensile support member may be rebar that is machined to have a smooth surface at the proximate end 11 and is threaded at the distal end 15 to engage a conventional bale at the distal end. The gouging member segment may be a bearing selected from the group consisting of ball bearings, needle bearings, roller bearings, gouging member bearing and a combination thereof.

FIG. 6 displays and embodiment to show the movement with an indicator 10 a visual indicator applied to the exposed proximate end 11 of the elongated tensile support after the pretensioning member has been utilized so that the reading exposed will correlate to distance traveled of the receiving body since pretensioning. Cap 76 falls off after initial movement showing a quick indicator of recent activity.

FIGS. 7–12 shows an embodiment of an adjustable yield grouted rock anchor bolt comprising an elongated tensile support member 112 wherein at least one gouging member segment 128, wherein the gouging member segment has an interference fit 140 with the elongated tensile support member 112. The receiving body 114 with a opening (bore) 116 that is dimensioned to receive the elongated tensile support member 112 within the opening (bore) 116, and the opening (bore) 116 having at least one retaining indent 118 to position and hold the gouging member segment 128 there between, wherein the elongated tensile support member extends beyond the receiving body a length 130 that corresponds to a predetermined amount of yield before ultimate failure. The elongated tensile support member includes a debonder placed upon the elongated tensile support member. The debonder is selected from the group consisting of wax, plastics, sleeves or combinations thereof.

FIG. 9 shows wherein the indent 118 to position and hold the gouging member segment 128 is a groove along the opening (bore) of the receiving body ending in a flat step 121 having a step height 122 that determines the amount of interference 140 between the gouging member segment and the elongated tensile support member, the step height is typically 25–75% of the diameter of the gouging member segment such as a ball bearing.

Figure 19A:
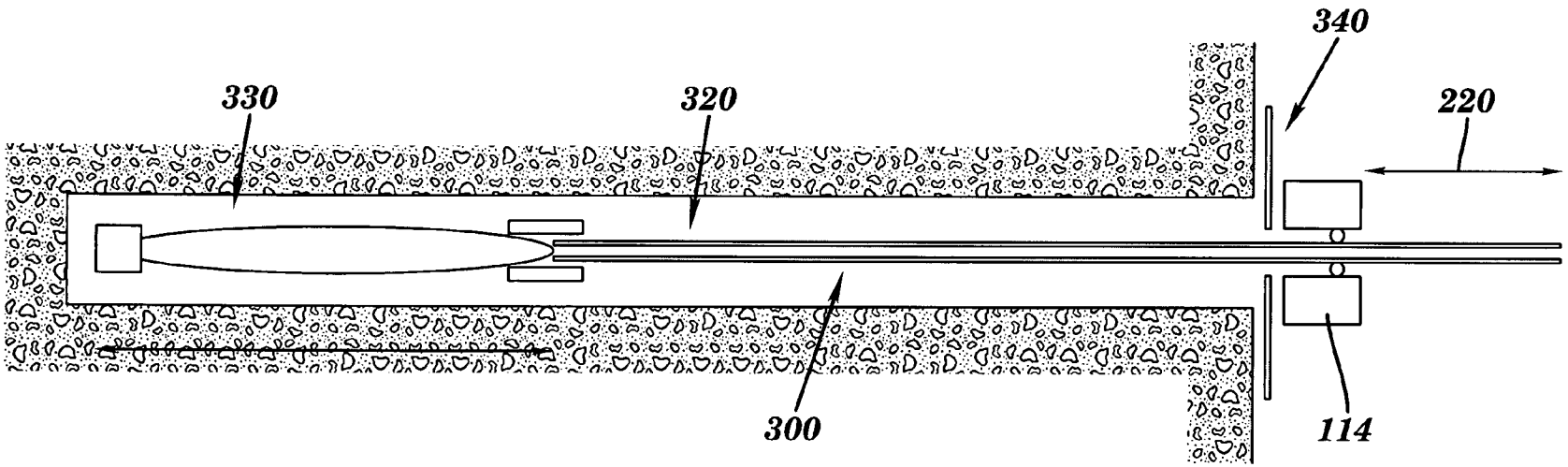
FIG. 19A an installed hydraulic pressure expendable anchored externally yielding anchor.
Figure 19D:
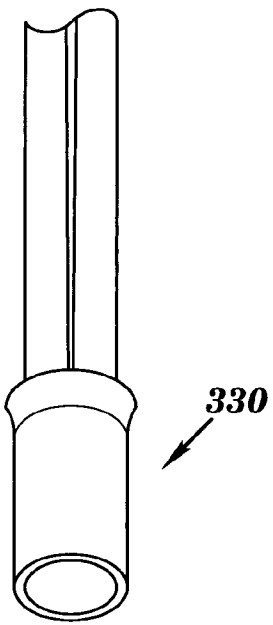
FIG. 19D the hydraulically exapndable anchor shown fully expanded.
Figure 19C:
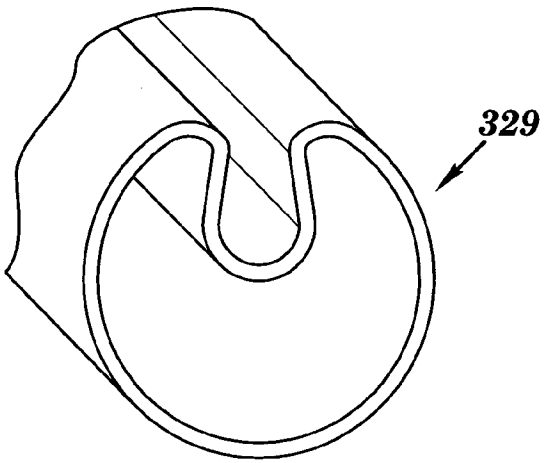
FIG. 19C the hydraulically expandable anchor shown partially expanded.
Figure 19B:
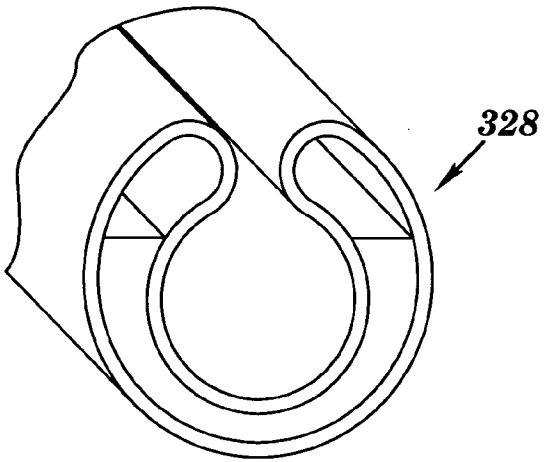
FIG. 19B the hydraulically expandable anchor.

FIG. 19A displays an embodiment of an adjustable externally yielding hybrid rock anchor bolt comprising a hollow elongated tensile support member 300 having a proximate end 310 and a distal end 320. FIG. 19B shows the process of taking unexpanded hollow bolt 328 and forcing by hydraulic pressure into expanded hollow bolt 329 that then anchors the bolt into the surrounding walls to secure the end of installed expanded bolt 330. FIG. 7–9 shows at least one gouging member segment 128, wherein the gouging member segment 128 has an interference fit 140 with the hollow elongated tensile support member 300. A receiving body 114 with a opening (bore) 116 that is dimensioned to receive the hollow elongated tensile support member 300 at the proximate end 310 within the opening (bore) 116 and the opening (bore) 116 having at least one retaining indent 118 to position and hold the gouging member segment 128 there between, wherein the proximate end 310 of elongated tensile support member 300 extends beyond the cylinder a length that corresponds to a predetermined amount of yield before ultimate failure.

A swellable hollow bolt (Swellex® bolt) 330 affixed to the distal end 320 of the hollow elongated tensile support member 300. A visual indicator 315 can be affixed to the proximate end 310 of the hollow elongated tensile support member 300 that extends beyond the receiving body. A faceplate washer 340 can be positioned between the receiving body 114 and the rock face 400 when installed. The distal end 320 of the hollow elongated tensile support member 300 is typically threaded to accept the Swellex® bolt 330 so as to prevent any leaks during expansion. A Swellex® bolt is defined as a partially compressed hollow tube that expands when injected with high pressure water or other incompressible fluid.

Figure 20:
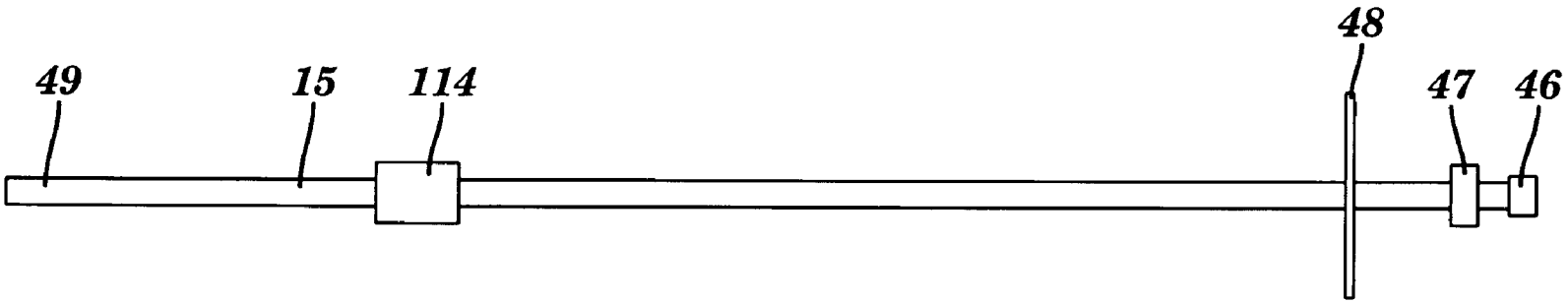
FIG. 20 an uninstalled yielding grouted rock anchor.
Figure 21:
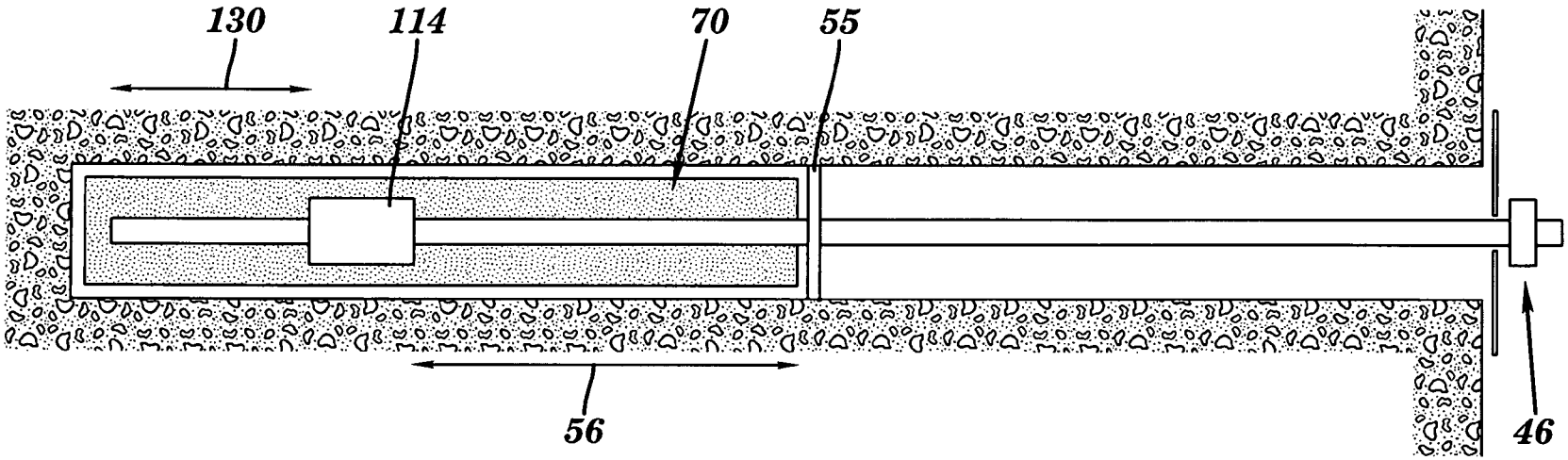
FIG. 21 is a partially grouted yieldable anchor.

In FIGS. 20–23 is an additional embodiment that can be representative of either a fully or partially grouted adjustable yield rock anchor bolt that comprises an elongated tensile support member 10 having a proximate end 11 and a distal end 15. In FIG. 20 the assembled yieldable rock bolt is shown before being installed and grouted. The receivable body 114 is installed onto elongated tension member 10 at the distal end 15, which has a smooth surface. The distal end 15 at the tip 49 can be mushroomed to prevent the passage of receivable body 114. At the proximate end 11 the washer 48 and optional conical seat 47 that is held in place by retaining nut 46 at the end. As displayed in FIGS. 7–9 at least one gouging member segment 128, wherein the gouging member segment 128 has an interference fit to cause gouges 140 with the elongated tensile support member 10. The gouges 140 are what absorbs the energy of rock movement without having the bolt reach ultimate failure and break in other conventional systems. FIG. 21 is an installed yieldable rock bolt that is partially grouted 70 having a suitable grout plug 55 attached to the rod 10 (with or without a breather tube). The partially grouted system is set to have a minimum anchor length 56 to prevent unintended failure from having an insufficient column of grout to support the load.

Figure 22:
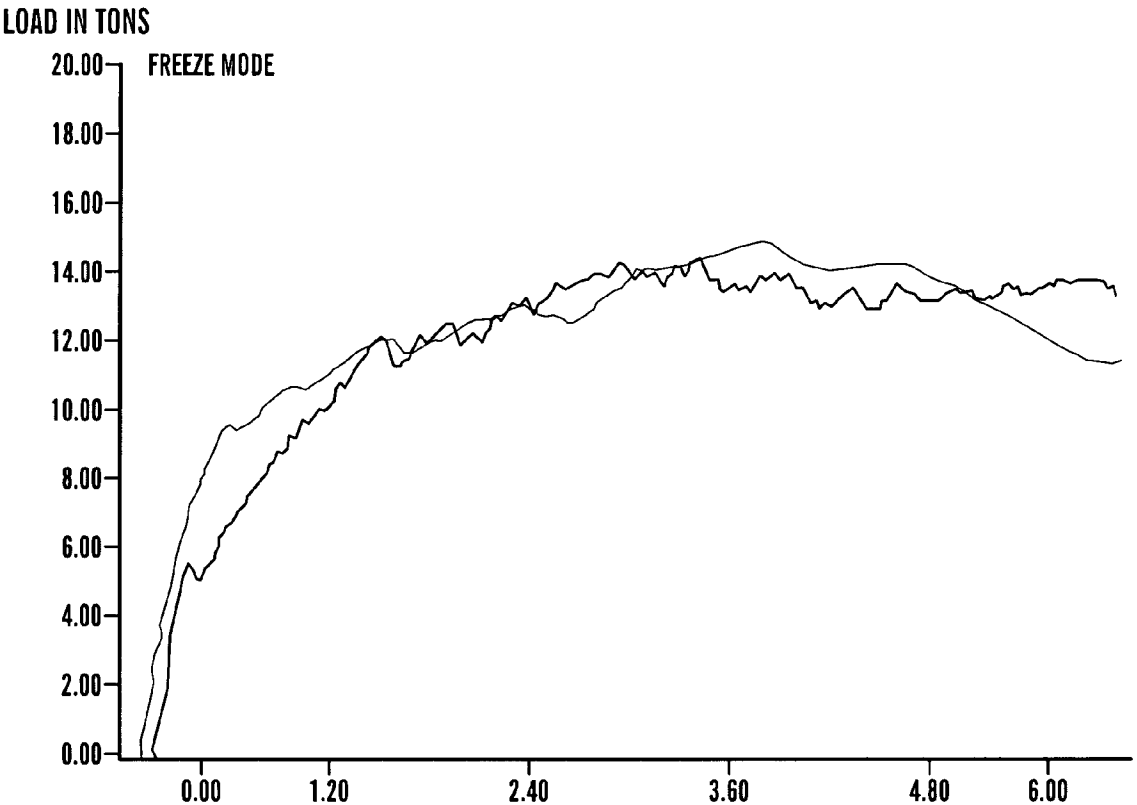
FIG. 22 is test results of the invention with 6 inches of yield when fully grouted.
Figure 23:
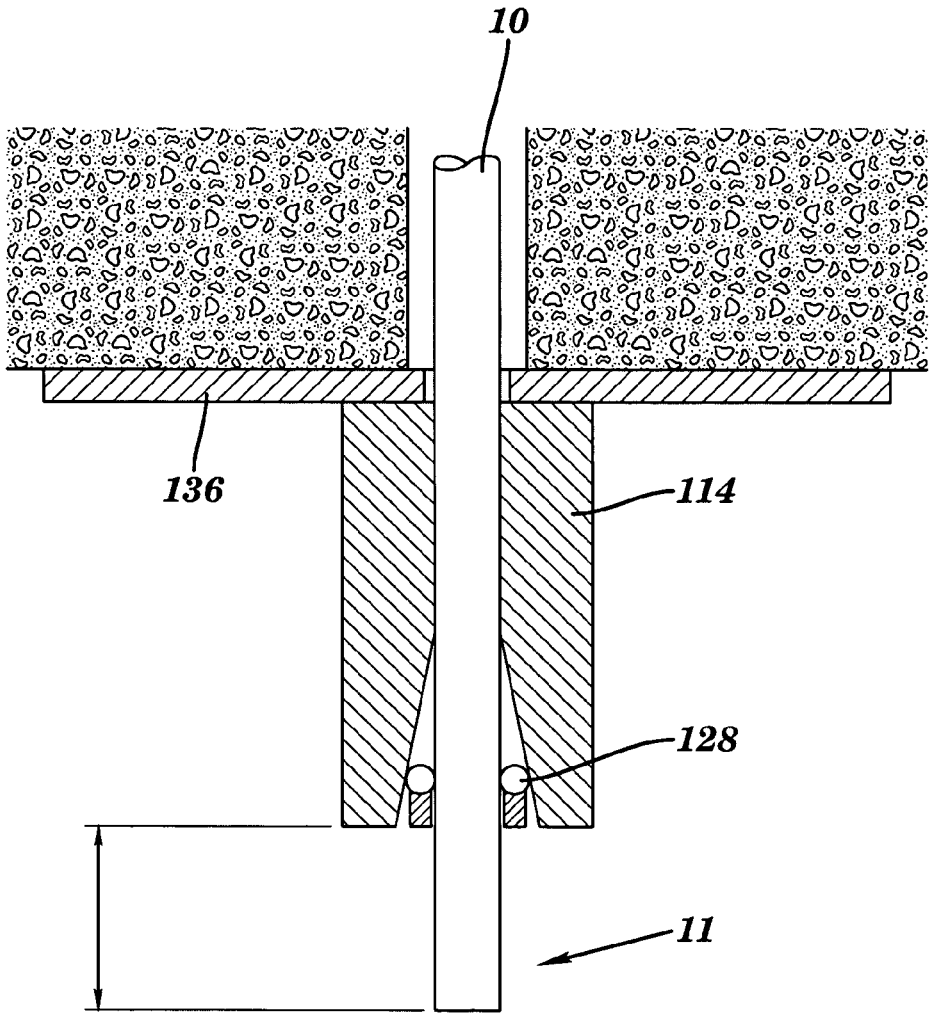
FIG. 23 is a partially grouted rockbolt with an external yielding with movement indicator.

FIG. 22 displays testing of the invention when fully grouted, having a yield length 130 set at six inches of travel. The ends were not mushroomed or crimped so that at the end of the yield length 130 the receiving body 114 passed off the end of the elongated member 10. The test examples were grouted into a steel tube and then pulled out. They used the same C1070 steel ⅝" diameter smooth bar as the mechanically anchored rockbolts. The above tests used a bale with 3 slots each with an 0.187" diameter ball bearing with a seating step on the bale of 0.11", showed that a peak load of 14 tons during yield travel.

The receiving body 110 with a opening (bore) 116 that is dimensioned to receive the elongated tensile support member 10 at the proximate end 11 within the opening (bore) 116 and the opening (bore) 116 having at least one retaining indent 118 to position and hold the gouging member segment 128 there between, wherein the proximate end 11 of the elongated tensile support member 10 extends beyond the receiving body 110 a length 130 that corresponds to a predetermined amount of yield before ultimate failure.

Figure 24:
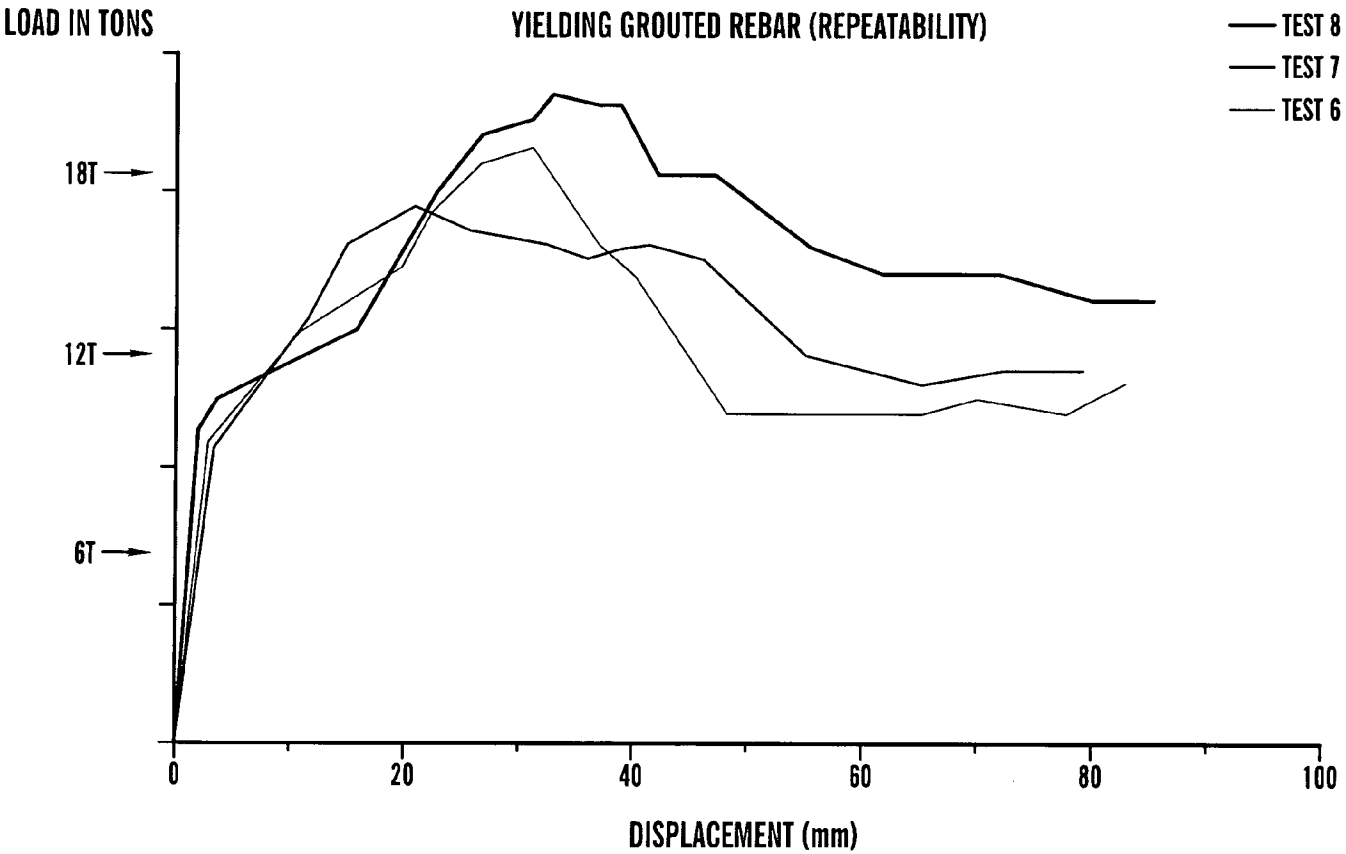
FIG. 24 is the testing of grouted rebar.

A movement indicator such as visual markings may be added on the proximate end 11 of the elongated tensile support member 10 that extends beyond the receiving body. The visible length of the exposed proximate end 11 itself is a visual indicator, but if the rock face is undergoing a slow creep that may be unnoticed over a period of time the addition of a set of measured distance markings, such as present on a ruler could be applied. Also other forms of movement indicators such as trip flags, or warning buzzers, alarms or flashing lights if a contact is broken after predetermined amount of movement of the receiving body 114 down the length of the exposed proximate end 11. When the tensile support member 10 is rebar it is usually machined to have a smooth surface at the proximate end 11 for greater repeatability as was tested in FIG. 24 of one example of a grouted rebar. The elongated tensile member 10, when either fully or partially grouted, must be treated with a debonder that is typically selected from the group consisting of wax, plastics, sleeves or combinations thereof.

The gouging member segment 128 can be any form of material hard enough to gouge 140 the elongated tension member 10. The only limitation is that the gouging member segment 128 must be a separate moveable piece in relation to both the receiving body 114 and the elongated tensile support member 10. Testing has shown that the combination of the gouging member segment 128 into the receiving body 114 leads to reduced yields and early failure due to early lockup that results in the premature breakage of the elongated tensile member 10.

When the gouging member segment 128 is a bearing selected from the group consisting of ball bearings, needle bearings, roller bearings, gouging member bearing and a combination thereof. The receiving body 114 must have the retaining indent 118 tailored to maximize performance with respect to each gouging member segment selected. The retaining indent 118 determines the amount of interference between the gouging member segment 128 and the receiving body 114, but other factors effect the overall performance of the receiving body 114. The receiving body 114 must allow for the material that is being gouged 140 to be ejected from the receiving body 114 or premature lockup of the gouging member segment 128 may occur and premature ultimate failure would happen. The receiving body 114 must also ensure that the tensile support member 10 travels in a straight path through the receiving body 114 to prevent tilting of the receiving body 114 that may lock up one of the gouging elements 128 also.

FIGS. 1, 5 displays embodiments for a device for setting pretension on a yielding rock anchor comprising a body 76 capable of transmitting force to a (bale) receiving body 114 that contains an elongated tension member 10 and a gouging member 128 therein at an untensioned position. The body 76 contains a device 77 to develop force through the body 76 to move an elongated tension member 10, a receiving body (bale) 114, and a gouging member 128 into a tensioned position defined where the elongated tension member 10 moves with respect to the bale 114 and the gouging member 128, the gouging member 128 causing deformation in the elongated tension member 140. The device 77 can deliver force through the body 76 by a set of threads that expands the diameter of the body 76 when rotated causing the elongated tensile support member to go into a state of tension. The body 76 can also be a hollow metal donut that expands when under hydraulic pressure to preset the bale (see Swellex®) as an example. The device 77 can also be a hydraulic ram that moves the bale with respect to the elongated tension member. The device 77 can also be a gouging member that is forced between the bale and a washer to move the bale with respect to the elongated tension member. The device 77 can also be a tapered roller, similar to a camshaft lobe, that expands when rotated forces the body to expand against the bale.

Figure 25:
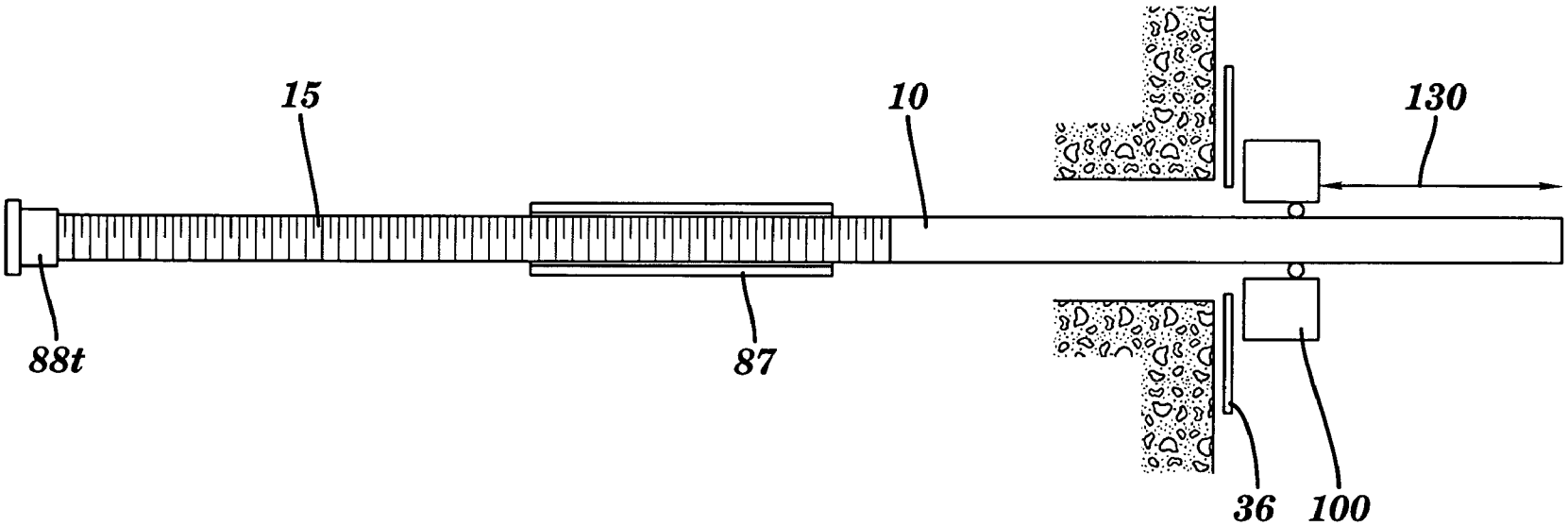
FIG. 25 is a self drilling anchor with external yielding anchor.

FIG. 25 is a modification of the general idea with the distal end 15 of the elongated tensile member containing a sacrificial drill bit 88 that remains embedded after a sufficient drilling depth has been reached. The proximate end 11 contains the receiving member that contains the gouging members. This version is useful with indicators because the proximate end 11 always has the yielding anchor at that end. The difference between the hybrid yielding self drilling anchor and a conventional self drilling anchor is that at least the last rod has only a small threaded section to secure it to the coupling 87 and the rest of the bar is threaded.

Figure 26A:
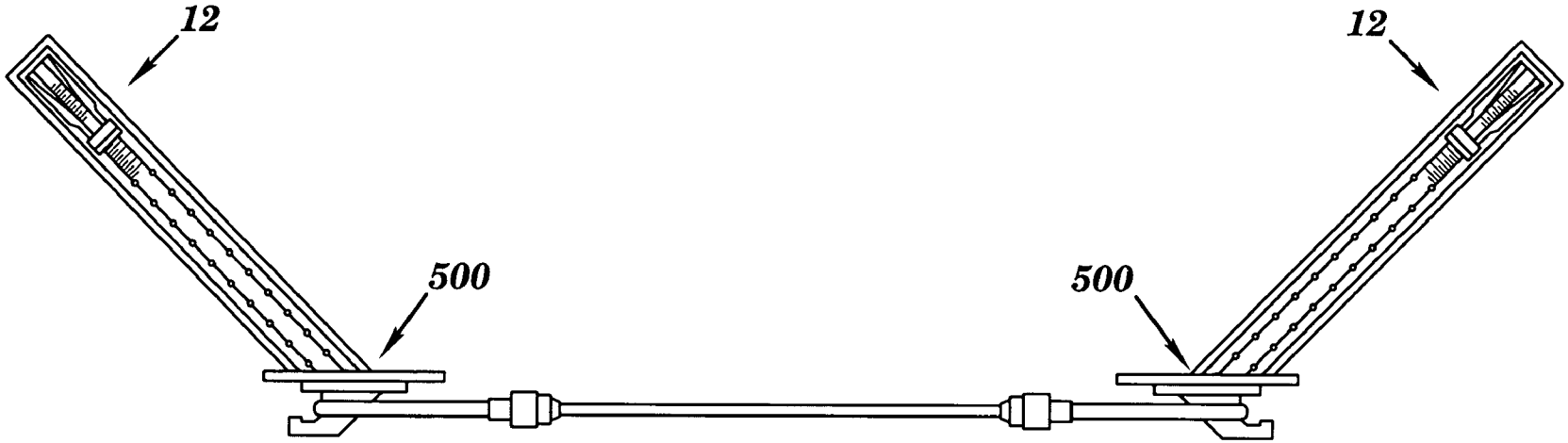
FIG. 26 is a yielding truss bolt.
Figure 26B:
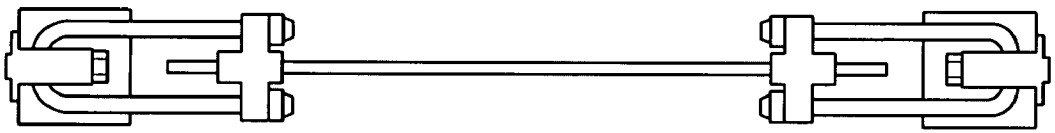

FIG. 26 shows a truss bolt could be made yielding by either using a yielding mechanical anchor 100, or replacing the wedges 75 with a yielding bale type lock. A pair of mechanical shell 12 or grouted columns anchor truss plate 500.

In another embodiment the method of adjusting the total yield of a rock anchor comprising the steps of:

First selecting an elongated tension member having a known plastic yield. The plastic yield is defined as the permanent stretch that occurs when the steel is subjected to tension beyond its elastic recovery range, but before it reaches ultimate failure and breaks. The point of plastic yield is important for maximizing the properties of the invention to give extended yield before failure. If a material has too low of a plastic yield then it can be replaced with a different material, replaced with a material having a greater sized cross section (diameter if a round section is used), or to a multiple system where several elongated tension members are affixed within a single receiving body. When small controlled displacements of only 6 inches of less are required it is allowable to operate within the plastic yield zone of the elongated tensioning element 10.

Once the plastic deformation of the elongated tensile material is known begins the selecting at least one gouging member element. The gouging member element can be any size or shape with the only limitation that it should have a greater hardness than that of the elongated tensile member to prevent premature failure from wear. If it is softer than the receiving member or elongated tensioning member, the load during controlled displacement could reduce as the gouging element is eroded and hence is reducing in contact with the elongated tensile member. The number of gouging member elements can range from one to almost infinite as long as the number of gouging member elements do not interfere with each other and cause the elongated tension member to jam within the receiving member and snap.

The next step is in selecting the amount of interference between the gouging member element and the elongated tension member. The factors that must be considered is that the interference must not be so great for one gouging member element that it could gouge to deep and pass out of the receiving body. The ideal depth of interference is 25–75% of the width of the gouging member element, each setup should be tested before use to determine that the depth is not so great so as to create lockup and plastic deformation of the elongated tension member.

In each situation a different load versus displacement capacity and reaction to shock is required to safely handle the job. Therefore by calculating to ensure the force of the yield caused by the amount of interference to be less than the force required for the plastic deformation of the elongated tension member one can ensure that the device yields in a predictable manner. The most stable yield readings (without force spikes or bouncing) occurs with a smooth surfaced elongated tension member, with multiple gouging member elements typically having no more than 50–75% interference depth. The interference depth being the depth of the gouge by the gouging element relative to the size of the gouging element.

Once the receiving body and gouging members have been optimized to the specific elongated tensile member selected then the setting of a length of the elongated tension member for the interference between the gouging member element and the elongated tension member. This is the total amount of force that will be absorbed prior to ultimate failure either by the receiving body passing of the end of the elongated tensile member or failure due to breakage. Typically the end of the elongated tension member is modified to prevent its passage through the receiving body to bring the tensile member to ultimate failure at the end. The factors that need to be considered is the amount of travel that is acceptable before the device ultimately fails.

The method of adjusting the total yield of a grouted rock anchor is similar to the above method comprising the steps of: selecting an elongated tension member having a plastic yield; selecting at least one gouging member element; selecting the amount of interference between the gouging member element and the elongated tension member.

The difference is in the step of selecting a grout having a known yield. This is partially determined by the condition of where the yielding rock bolt is being anchored. Some situations require very strong grout, such as cement, where other situations there may be very weak grout because of the strength of the surrounding rock layers. Therefore the yield of the grout can be a limiting factor when selecting the number, type and interference characteristics of the gouging member elements with the elongated tension members.

The step of calculating to ensure the force of the yield caused by the amount of interference to be less than the force required for the plastic deformation of the elongated tension member or the yield of the grout. The grout acts as an additional yield mechanism to take into consideration.

The final step is setting a length of the elongated tension member for the interference between the gouging member element and the elongated tension member. The grout should also be taken into consideration as this will add to the travel distance and should be factored in with the total yield being calculated.

The method for installing an adjustable yield mechanical rock anchor is similar to a conventional but with some differences. The first step in installing is the drilling a hole into a rock face. The standard hole is satisfactory without any modifications, but the hole must be of sufficient length to accept the total length of the anchor that includes the length of the elongated member that extends beyond the receiving member. The next step is selecting an anchor shell to coincide with the type of rock material. Then select an elongated tension member having a proximate and distal end and insert the distal end of the elongated tension member through the anchor shell. Then pass the distal end a predetermined distance beyond the anchor shell that corresponds to a desired yield. Then insert a gouging member element between the elongated tension member and the anchor shell to form the adjustable yield mechanical rock anchor. Insert the distal end of the elongated tension member of the adjustable yield mechanical rock anchor into the hole and then expand the anchor shell. Then it is possible to attach a plate to the proximate end. This method is typically performed at the factory prior to delivery to the customer, but the assembly of the invention and tensioning during initial installation can be done at the point of end use.

A different method for installing an adjustable yield mechanical rock anchor comprises: The drilling of a hole into a rock face and selecting an anchor shell that is suitable. Then select an elongated tension member having a proximate and distal end. Then insert the distal end of the elongated tension member through the anchor shell. Then insert the distal end of the elongated tension member and the anchor shell into the hole and expand the anchor shell.

Now select a receiving element (bale) having a opening (bore) and pass the proximate end a predetermined distance beyond the bale through the opening (bore) that corresponds to a desired yield. Then insert a gouging member element into the opening (bore) between the elongated tension member and the bale to form the adjustable yield mechanical rock anchor. A plate is attached to the proximate end between the receiving body and the rock face.

Another method for installing a grouted adjustable yield mechanical rock anchor comprises also drilling a hole into a rock face. Then select an appropriate grout for the rock condition. Then based on the grout select a receiving body (bale) having a opening (bore). Then select an appropriate elongated tension member having a proximate and distal end. Then insert the distal end of the elongated tension member through the opening (bore) of the bale. Then pass the distal end a predetermined distance beyond the bale that corresponds to a desired yield. Then insert a gouging member element into the opening (bore) between the elongated tension member and the bale to form the adjustable yield mechanical rock anchor. Now insert the distal end of the elongated tension member of the adjustable yield mechanical rock anchor into the hole. You may grout the hole before or after installing the rock anchor, and finally attaching a plate to the proximate end.

Another method for installing an adjustable yield mechanical rock anchor comprises: drilling a hole into a rock face; selecting an appropriate grout for the conditions; selecting an elongated tension member having a proximate and distal end; inserting the distal end of the elongated tension member through the anchor shell; inserting the distal end of the elongated tension member and the anchor shell into the hole; grouting the anchor shell; selecting a bale having a opening (bore); passing the proximate end a predetermined distance beyond the bale through the opening (bore) that corresponds to a desired yield; inserting a gouging member element into the opening (bore) between the elongated tension member and the bale to form the adjustable yield mechanical rock anchor; and, attaching a plate to the proximate end.

We claim:

1. An adjustable yield grouted rock anchor bolt comprising:

an elongated tensile support member;

at least one gouging member segment, wherein the gouging member segment has an interference fit with the elongated tensile support member;

a receiving body with an opening that is dimensioned to receive the elongated tensile support member within the opening, and the opening having at least one retaining indent to moveably couple the gouging member segment with respect to the receiving body and the elongated tensile support member during gouging, wherein the elongated tensile support member extends beyond the receiving body a length that corresponds to a predetermined amount of yield before ultimate failure; and a debonder placed upon the elongated tensile support member.

2. The apparatus of claim 1 wherein the debonder is selected from the group consisting of wax, plastics, oils, greases, soaps, solid lubricants, sleeves and combinations thereof.

3. The apparatus of claim 1 wherein the gouging member segment is a bearing selected from the group consisting of ball bearings, needle bearings, roller bearings, bearing, conical bearings, wedge bearings and a combination thereof.

4. The apparatus of claim 1 wherein the indent to position and hold the gouging member segment is a groove along the opening of the receiving body ending in a flat step having a step height that determines the amount of interference between the gouging member segment and the elongated tensile support member.

5. The apparatus of claim 4 wherein the gouging member segment is a hardened steel ball bearing and the step height is 25–75% of the diameter of the ball bearing.

6. The apparatus of claim 5 wherein the opening has at least one entrance diameter and a smaller seat diameter having an angle of 4–12 degrees there between, and wherein the opening has an anti-skewing section that forms a step between the seat diameter and the anti-skewing section.

7. The apparatus of claim 1 wherein the receiving body is filled with a plugging material.

8. The apparatus of claim 1 wherein the opening has at least four grooves, each groove having an incline of 6–8 degrees, a gouging member element being a steel ball bearing with a diameter of at least 0.156 inches, a step in each groove with a width of at least 0.125 inches wherein the ball bearing rests after being pretensioned.

9. The apparatus of claim 1 wherein the receiving member is pretensioned at the preselected yield load determined by the length of the elongated tensile support member extending beyond the receiving body.

10. An adjustable externally yielding hybrid rock anchor bolt comprising:

an hollow elongated tensile support member having a proximate end and a distal end;

at least one gouging member segment, wherein the gouging member segment has an interference fit with the elongated tensile support member;

a receiving body with an opening that is dimensioned to receive the elongated tensile support member at the proximate end within the opening, and the opening having at least one retaining indent to position and hold the gouging member segment there between, wherein the at least one gouging member segment is movable separately from the receiving body during gouging, wherein the proximate end of elongated tensile support member extends beyond the receiving body a length that corresponds to a predetermined amount of yield before ultimate failure;

a swellable bolt when pressurized affixed to the distal end of the hollow elongated tensile support member.

11. The apparatus of claim 10 further comprising:

a visual indicator affixed to the proximate end of the elongated tensile support member that extends beyond the receiving body.

12. The apparatus of claim 10 further including:

an indicator that attaches to the proximate end of the elongated member that falls off after a predetermined movement of the receiving body.

13. The apparatus of claim 10 wherein the gouging member segment is a bearing selected from the group consisting of ball bearings, needle bearings, roller bearings, conical bearings, wedge bearings and a combination thereof.

14. The apparatus of claim 10 wherein the distal end of the hollow elongated tensile support member is threaded to accept the swellable bolt.

15. The apparatus of claim 10 wherein a swellable bolt is defined as a partially compressed hollow tube that expands when injected with high pressure water.

16. The apparatus of claim 10 wherein the opening has at least one entrance diameter and a smaller seat diameter having an angle of 4–12 degrees there between.

17. The apparatus of claim 16 wherein the opening has an anti-skewing section that forms a step between the seat diameter and the anti-skewing section.

18. The apparatus of claim 17 wherein the anti-skewing section has an inner dimension that is not greater than 10% larger than the outer dimension of the elongated tensile support member.

19. The apparatus of claim 10 wherein the opening has at least four grooves, each groove having an incline of 6–8 degrees, a gouging member element being a steel ball bearing with a diameter of at least 0.156 inches, a step in each groove with a width of at least 0.125 inches wherein the ball bearing rests after being pretensioned.

20. A grouted adjustable yield rock anchor bolt comprising:

an elongated tensile support member having a proximate end and a distal end;

at least one gouging member segment, wherein the gouging member segment has an interference fit with the elongated tensile support member;

a receiving body with a opening that is dimensioned to receive the elongated tensile support member at the proximate end within the opening and the opening having at least one retaining indent to position and hold the gouging member segment there between, wherein the proximate end of the elongated tensile support member extends beyond the receiving body a length that corresponds to a predetermined amount of yield before ultimate failure;

an movement indicator on the proximate end of the elongated tensile support member that extends beyond the receiving body.

21. The apparatus of claim 20 further comprising:

a debonder, wherein the debonder is selected from the group consisting of wax, plastics, sleeves or combinations thereof.

22. The apparatus of claim 20 wherein the gouging member segment is a bearing selected from the group consisting of ball bearings, needle bearings, roller bearings, conical bearings, wedge bearings and a combination thereof.

23. The apparatus of claim 20 wherein the indent to position and hold the gouging member segment is a groove along the opening of the receiving body ending in a flat step having a step height that determines the amount of interference between the gouging member segment and the elongated tensile support member.

24. The apparatus of claim 23 wherein the gouging member segment is a hardened steel ball bearing and the step height is 25–75% of the diameter of the ball bearing.

25. The apparatus of claim 24 wherein the opening has at least one entrance diameter and a smaller seat diameter having an angle of 4–12 degrees there between, and wherein the opening has an anti-skewing section that forms a step between the seat diameter and the anti-skewing section.

26. The apparatus of claim 20 wherein the receiving body is filled with a plugging material.

27. The apparatus of claim 20 wherein the opening has at least four grooves, each groove having an incline of 6–8 degrees, a gouging member element being a steel ball bearing with a diameter of at least 0.156 inches, a step in each groove with a width of at least 0.125 inches wherein the ball bearing rests after being pretensioned.

28. The apparatus of claim 20 wherein the movement indicator is an audible or visual alarm that is trigger by a predetermined amount of movement of the receiving body along the proximate end of the elongated tensile support member.

29. A device for setting pretension on a yielding rock anchor comprising:

a body capable of transmitting force to a bale that contains an elongated tension member and a gouging member therein at an untensioned position;

a device positioned at a proximate end of the elongated tension member to develop force through the body to move the elongated tension member, the bale, and the gouging member into a tensioned position defined where the elongated tension member moves with respect to the gouging member, the gouging member causing deformation in the elongated tension member by gouging, wherein the elongated tension member extends beyond the gouging member to allow for controlled yield through further gouging of the elongated tension member.

30. The apparatus according to claim 29 wherein the device to deliver force through the body is a set of threads within the body that expands the height of the body when rotated causing the elongated tensile support member to go into a state of tension.

31. The apparatus according to claim 29 wherein the device to develop force is an hollow metal donut that expands when under hydraulic pressure to preset the bale.

32. The apparatus according to claim 29 wherein the device is a hydraulic ram that moves the bale with respect to the elongated tension member.

33. The apparatus according to claim 29 wherein the bale has a flute, where the device is a gouging member that is forced between the bale within the flute, and a washer with a nut to move the bale with respect to the elongated tension member, wherein the elongated tension member extends beyond the bale adjacent the gouging member.

34. The apparatus according to claim 29 wherein the device is a tapered roller that expands when rotated forcing the body to expand against the bale.

35. The method of adjusting the total yield of a rock anchor comprising the steps of:

selecting an elongated tension member having a plastic yield;

selecting at least one gouging member element;

selecting the amount of interference between the gouging member element and the elongated tension member;

calculating to ensure the force of the yield caused by the amount of interference to be less than the force required for the plastic deformation of the elongated tension member; and setting a length of the elongated tension member for the interference between the gouging member element and the elongated tension member.

36. The method of claim 35 further comprising the steps of:

selecting a grout having a yield;

calculating to ensure the force of the yield caused by the amount of interference to be less than the force required for the plastic deformation of the elongated tension member or the yield of the grout.

37. A method according to claim 35 further comprising:

selecting an anchor shell;

inserting the distal end of the elongated tension member through the anchor shell;

passing the distal end a predetermined distance beyond the anchor shell that corresponds to a desired yield;

inserting a gouging member element between the elongated tension member and the anchor shell to form the adjustable yield mechanical rock anchor;

pre-tensioning the adjustable yield mechanical rock anchor.

38. A method according to claim 35 further comprising:

drilling a hole into a rock face;

inserting the distal end of the elongated tension member through the anchor shell;

inserting the distal end of the elongated tension member and the anchor shell into the hole;

expanding the anchor shell; and attaching a plate to the proximate end.

39. A method according to claim 35 further comprising:

drilling a hole into a rock face;

selecting an appropriate grout for the rock condition;

inserting the adjustable yield mechanical rock anchor into the hole;

grouting the hole; and attaching a plate to the proximate end.

40. A method according to claim 35 further comprising:

drilling a hole into a rock face;

selecting an appropriate grout for the conditions;

inserting the distal end of the elongated tension member through the anchor shell;

inserting the distal end of the elongated tension member and the anchor shell into the hole;

grouting the anchor shell;

selecting a bale having a opening;

passing the proximate end a predetermined distance beyond the bale through the opening that corresponds to a desired yield;

inserting a gouging member element into the opening between the elongated tension member and the bale to form the adjustable yield mechanical rock anchor; and attaching a plate to the proximate end.

* * * * *

UNITED STATES PATENT AND TRADEMARK OFFICE

CERTIFICATE OF CORRECTION

PATENT NO. : 7,147,404 B2
APPLICATION NO. : 11/231184
DATED : December 12, 2006
INVENTOR(S) : Spearing et al.

It is certified that error appears in the above-identified patent and that said Letters Patent is hereby corrected as shown below:

Column 1
Line 17, delete “stabilisation” and insert -- stabilization --
Line 52, delete “dimension receive” and insert -- dimensioned to receive --

Column 2
Line 33, delete “an” and insert -- a --
Line 44, delete “a opening” and insert -- an opening --

Column 3
Line 62, delete “whole” and insert -- hole --

Column 4
Line 16, delete “having a” and insert -- having an --

Column 5
Line 35, delete “a” and insert -- an --

Column 12
Lines 32 and 48, delete “show” and insert -- shown --

Column 14
Line 8, delete “and” and insert -- an --

Column 17
Line 18, delete “of less” and insert -- or less --

Column 20
2Line 24, delete “an” and inseret -- a --

Column 21
Line 28, delete “an” and insert -- a --
Line 64, delete “trigger” and insert -- triggered --

UNITED STATES PATENT AND TRADEMARK OFFICE

CERTIFICATE OF CORRECTION

PATENT NO. : 7,147,404 B2
APPLICATION NO. : 11/231184
DATED : December 12, 2006
INVENTOR(S) : Spearing et al.

It is certified that error appears in the above-identified patent and that said Letters Patent is hereby corrected as shown below:

Column 22
Line 24, delete “an” and insert -- a --

Signed and Sealed this

Sixth Day of March, 2007

JON W. DUDAS
*Director of the United States Patent and Trademark Office*